United States Patent [19]

Suzaki et al.

[11] Patent Number: 4,598,301

[45] Date of Patent: Jul. 1, 1986

[54] THERMAL PRINTER

[75] Inventors: Masayuki Suzaki, Fujisawa; Shoji Nishiwaki, Machida; Toshitaka Hayashima, Hatano; Shigeyuki Araki, Komae; Masanori Momose, Hiratsuka, all of Japan

[73] Assignee: Ricoh Company, Ltd., Tokyo, Japan

[21] Appl. No.: 594,682

[22] Filed: Mar. 29, 1984

[30] Foreign Application Priority Data

| | | | |
|---|---|---|---|
| Mar. 31, 1983 | [JP] | Japan | 58-55751 |
| Mar. 31, 1983 | [JP] | Japan | 58-55752 |
| Mar. 31, 1983 | [JP] | Japan | 58-55753 |
| Apr. 28, 1983 | [JP] | Japan | 58-75085 |

[51] Int. Cl.[4] ..... B41J 33/14

[52] U.S. Cl. ..... 346/76 PH; 346/105; 400/208; 400/233; 400/120

[58] Field of Search ..... 400/207, 208, 233, 120; 346/76 PH, 105; 219/216 PH

[56] References Cited

U.S. PATENT DOCUMENTS 4,420,268 12/1983 Tsukamura et al. ..... 400/208

FOREIGN PATENT DOCUMENTS 0110285 6/1983 Japan ..... 400/208

*Primary Examiner*—E. A. Goldberg
*Assistant Examiner*—A. Evans
*Attorney, Agent, or Firm*—Cooper, Dunham, Clark, Griffin & Moran

[57] ABSTRACT

A thermal printer for printing characters or the like on a recording medium, heat-sensitive paper or plain paper, by a thermal printhead which is mounted on a carriage movable along the recording medium in a reciprocating manner is provided. The printhead is pressed against the recording medium while the carriage is moving in a printing direction and the printhead is kept away from the recording medium while the carriage is moving in a returning direction opposite to the printing direction. A cassette containing therein heat-sensitive ink ribbon is substantially elongated in shape and it bridges between a pair of side plates forming part of a frame of the printer when detachably mounted in position. The cassette is provided with a supply port at one end and a take-up port at the opposite end and thus the ribbon is lead outside through the supply port and lead inside through the take-up port. And the ribbon is taken up in association with the returning motion of the carriage.

24 Claims, 62 Drawing Figures

THERMAL PRINTER

BACKGROUND OF THE INVENTION

1. Field of the Invention

This invention relates to a thermal printer and particularly to a thermal serial printer for printing characters along a printing line by a thermal printhead mounted on a carriage which is movable in a reciprocating manner.

2. Description of the Prior Art

Thermal printers are well known in the art and they may be generally classified into two categories. In one category, which may be called a transfer type thermal printer, heat-sensitive ink ribbon is placed between a thermal printhead and a recording medium of plain paper and the ink on the ink ribbon is selectively transferred to the plain paper by the printhead. On the other hand, in the other category, which may be called a direct type thermal printer, use is made of heat-sensitive paper as a recording medium and characters are recorded directly on the heat-sensitive paper by the thermal printhead. In so-called hybrid thermal printers in which plain paper and heat-sensitive paper may be interchangeably used as a recording medium, if it is desired to use heat-sensitive paper, the heat-sensitive ink ribbon must be removed.

In prior art thermal printers, it was typical to mount a ribbon cassette containing therein heat-sensitive ink ribbon directly on a carriage movable along a platen in a reciprocating manner in order to set the heat-sensitive ink ribbon in position. With such a prior art structure, however, it is necessary to provide an ink ribbon advancing mechanism in the carriage itself so that the carriage provided with a printing mechanism tends to become complicated in structure and heavy in weight. For this reason, a driving mechanism needed to move the carriage along the platen requires a motor having a large capacity, which, in turn, requires large power consumption. In addition, the carriage necessarily becomes larger in size because the ribbon cassette is mounted thereon, which then causes the printer as a whole to be larger in size.

Another prior art thermal printer is shown in FIG. 1, in which a pair of ribbon spools 1 and 2 are provided on both sides of a printer frame 3 and heat-sensitive ink ribbon 4 is extending between the pair of spools 1 and 2 as passing through a printing section of a carriage 5. With such a structure, it is true that the carriage 5 may be made light in weight, but difficulty exists in setting the ribbon 4 in the printing position and removing the ribbon 4 from the printing position. That is, since the ribbon spools 1 and 2 are located far away one from each other and the ink ribbon 4, which is relatively thin, extends over a long distance, it is difficult to set or remove the ink ribbon 4. Particularly, it is extremely difficult to remove the ink ribbon 4 when a recording medium 6 is switched from plain paper to heat-sensitive paper because the ribbon spools 1 and 2 must be removed one by one and that portion of the ribbon extending between the spools 1 and 2, which includes used and non-used portions, must be wound into either one or both of the spools 1 and 2. However, since the ribbon 4 is relatively thin, that lead out portion tends to curl when the spools 1 and 2 are removed, and, thus, it is often the case that the lead out portion must be wound up into the take-up spool 2 when the ink ribbon 4 is to be set in position again. It is true that various ink ribbon cassettes are used in conventional impact printers; however, these ink ribbon cassettes cannot be applied to thermal printers.

SUMMARY OF THE INVENTION

It is therefore a primary object of the present invention to obviate the above-described disadvantages of the prior art and to provide an improved thermal printer.

Another object of the present invention is to provide a thermal printer in which an ink ribbon cassette containing therein ink ribbon may be easily and smoothly mounted without producing a loss in the ink ribbon.

A further object of the present invention is to provide a thermal printer in which heat-sensitive paper and plain paper may be interchangeably used efficiently as well as simply.

A still further object of the present invention is to provide a thermal printer capable of using differently sized paper with ease.

A still further object of the present invention is to provide a thermal printer provided with a paper setting mechanism which allows the setting of recording paper easily as well as securely.

Other objects, advantages and novel features of the present invention will become apparent from the following detailed description of the invention when considered in conjunction with the accompanying drawings.

BRIEF DESCRIPTION OF THE DRAWINGS

FIGS. 19 and 20 are schematic illustrations, each showing a printhead pressing mechanism of the printer of FIG. 2, wherein FIG. 19 shows the condition in which the printhead is to be moved away from the platen by the pressing mechanism and FIG. 20 shows the condition in which the printhead is to be pressed against the platen by the pressing mechanism;

FIGS. 57 and 58 are schematic illustrations each showing the ink ribbon guide mechanism constructed in accordance with one embodiment of the present invention as provided in a transfer type thermal printer, wherein FIG. 57 shows the state in which the thermal printhead is pressed against the platen and FIG. 58 shows the state in which the thermal printhead is separated away from the platen;

DESCRIPTION OF THE PREFERRED EMBODIMENTS

Figure 1:
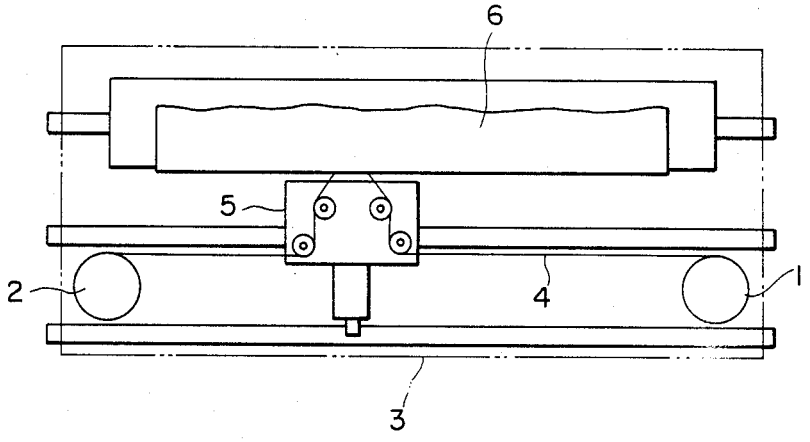
Fig. 1 PRIOR ART
FIG. 1 is a schematic illustration showing a typical prior art thermal printer.
Figure 2:
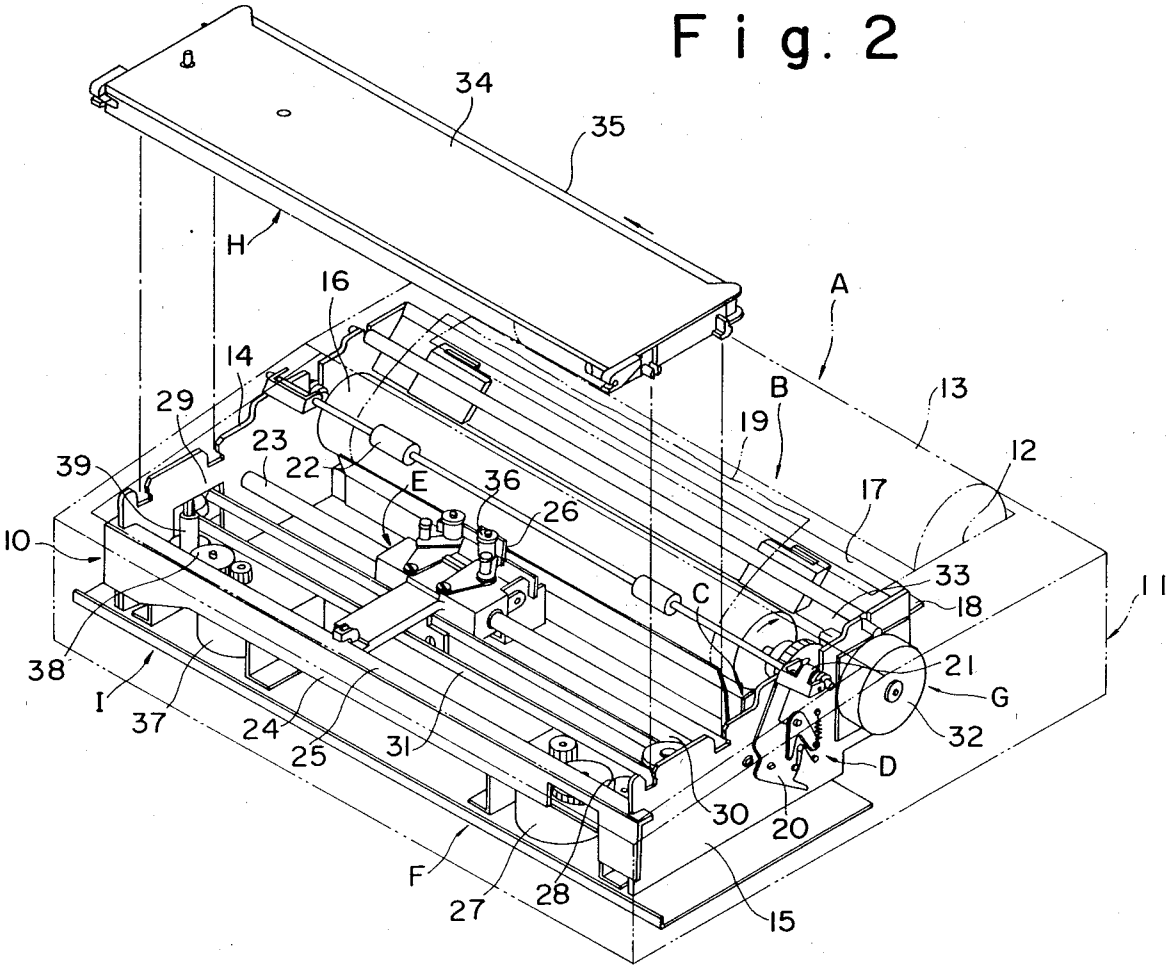
FIG. 2 is a perspective view showing a thermal printer and an ink ribbon cassette which may be detachably mounted in the printer constructed in accordance with one embodiment of the present invention.

Referring now to FIG. 2, there is shown a thermal printer 10 constructed in accordance with one embodiment of the present invention. In the illustrated thermal printer, plain paper and heat-sensitive paper may be used interchangeably, both either in the form of a cut sheet of paper or a roll of paper. The printer 10 itself is housed in a printer case 11 as indicated by the two-dotted line. Inside the case 11, a printing section is defined in the front side and a paper storing section A is defined in the rear side. The paper storing section A is defined by forming a semi-cylindrical recess 12 in the top surface of the printer case 11, in which a roll 13 of paper is stored as indicated by the two-dotted line.

The roll 13 of paper is fed into the printer section 10 through a paper supplying section B which includes a pair of guide plates 17 and 18 extending between side plates 14 and 15 behind a platen 16 also extending between the side plates 14 and 15. The guide plates 17 and 18 are disposed one on top of the other spaced apart one from the other. At the entrance of the upper guide plate 17 is defined an upwardly opened supply port for a cut sheet of paper, and a reawardly opened supply port for the paper unwound from a roll is defined at the entrance of the lower guide plate 18. The paper fed through either one of the supply ports advances as guided by a paper guiding mechanism C disposed below the platen 16 and wound around the platen 16 from its bottom.

For example, paper 19 fed through the roll paper supply port comes to be wound around the platen 16 as shown. After correcting the skew of the paper 19 by hands, it is placed in close contact with the platen 16 and then a paper setting mechanism D is operated to place the paper 19 in a set condition. The paper setting mechanism D is structured such that by moving a knob 21 of a paper setting lever 20 either to the front or to the rear, paper pressing rollers 22 and paper transport rollers ( not shown ) are brought into contact with or separated away from the platen 16.

A guide shaft 23 is provided in the printer section 10, and extends between the side plates 14 and 15 in front of and in parallel with the platen 16. There is provided a carriage E bridging the guide shaft 23 and a rail portion 25 which is formed by part of a front plate 24. A thermal printhead 26 is mounted on the carriage E such that its recording surface faces the paper set around the platen 16. The carriage E moves horizontally in a reciprocating manner along the platen 16, guided by the guide shaft 23 and driven by a carriage driving mechanism F. The carriage driving mechanism F is structured such that rotation of a carriage driving motor 27 is transmitted to one of the pulleys 29 and 30, or pulley 30 in the present embodiment, through a gear train 28 so that a carriage driving belt 31 extended between the pulleys 29 and 30 is caused to travel, thereby moving the carriage E.

On the other hand, the platen 16 is driven to rotate in the direction indicated by the arrow by means of a platen driving mechanism G, which operates such that rotation of the platen driving motor 32 is transmitted to the platen 16 through a platen gear train 33.

In the case when the paper set in the thermal printer is heat-sensitive paper, the thermal printhead 26 is brought into a direct contact with the paper on the platen 16 and then the heat-sensitive paper is colored or burned selectively while the carriage E moves to the right along a printing line. Upon completion of printing of a single printing line, the carriage E is returned to the left while rotating the platen 16 to advance the paper to the next printing line so that printing may be again carried out by moving the carriage to the right. This process may be repeated to effect printing on the heat-sensitive paper.

On the other hand, in the case where the paper set in the thermal printer is plain paper, a ribbon cassette H is attached to the printer section 10 to extend between the side plates 14 and 15. The ribbon cassette H includes a cassette main body 34 which contains therein heat-sensitive ink ribbon 35. When set in position, the ink ribbon 35 extending exteriorly of the cassette main body 34 is placed between the thermal printhead 26 and the paper and is guided by a ribbon guide roller 36 of the carriage E. Then, the printhead 26 is pressed against the paper around the platen 16 with the heat-sensitive ink ribbon 35 inserted therebetween, and printing is carried out with the carriage E moving to the right and transferring ink selectively from the ribbon 35 to the plain paper on the platen 16. Upon completion of printing of a single line, the carriage E is returned to the left and at the same time the ink ribbon 35 is caused to advance in the direction indicated by the arrow by means of an ink ribbon feeding mechanism I. Furthermore, the platen 16 is rotated to move the paper to a position ready for carrying out printing for the next line. Thus, printing may be again carried out while moving the carriage E to the right. By repeating the above-described process, printing may be effected on plain paper.

The ribbon feeding mechanism I is structured such that rotation of a ribbon driving motor 37 is transmitted to a driving shaft 39 through a ribbon feed gear train 38. When the ribbon cassette H is mounted on the printer section 10, the driving shaft 39 comes to be connected to a take-up driving roller provided in the ribbon cassette H.

Figure 3:
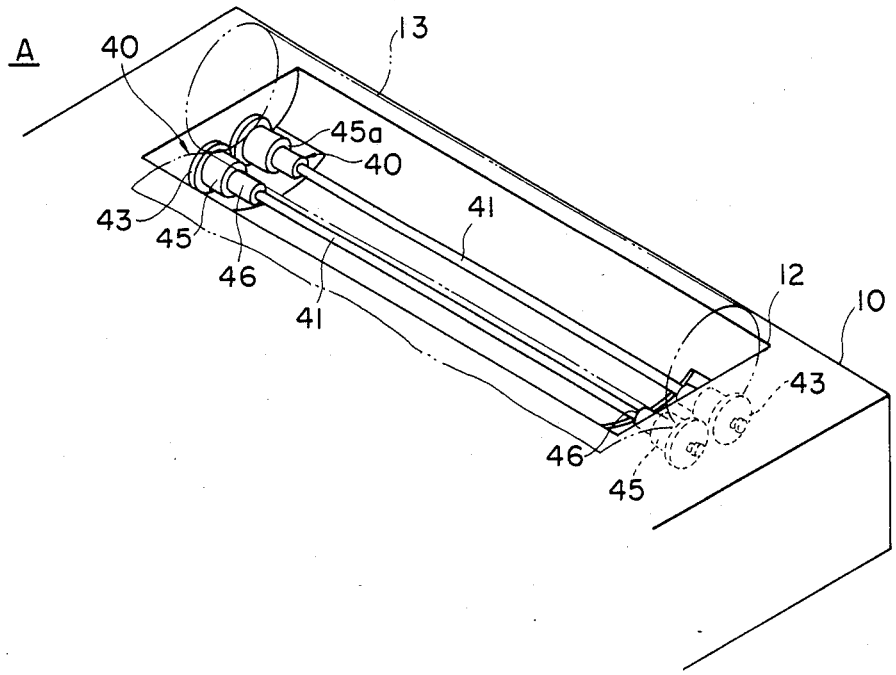
FIG. 3 is a fragmentary, perspective view showing a paper storing section A of the printer of FIG. 2.
Figure 4:
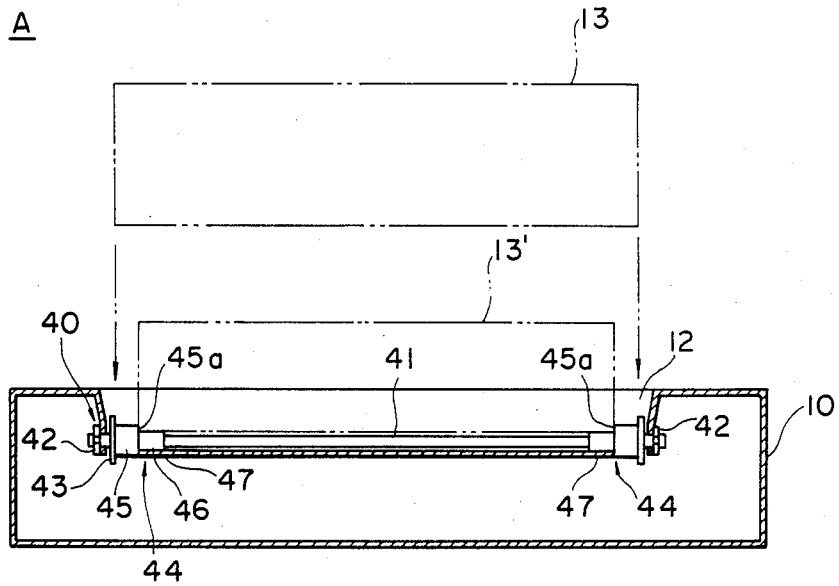
FIG. 4 is a schematic, cross-sectional view of the paper storing section A.

In the thermal printer having the overall structure as described above, the paper storing section A will be described further in detail below. In the semi-cylindrical recess 12 formed in the paper storing section A, a pair of holder members 40 are arranged in parallel such that a roll 13 of paper may ride thereon, as shown in FIGS. 3 and 4. Each of the holder members, 40, 40 includes a roller shaft 41 extending between the side walls of the semi-cylindrical recess 12. Each of these roller shafts 41, 41 is axially restrained, for example, by attaching fixing members 42 such as E-rings on both ends. On both ends of the roller shaft 41 are provided disc-shaped holder plates 43 which are located spaced apart from each other over a distance corresponding to the width of A4-sized roll paper 13. Moreover, the roller shaft 41 is provided with rotatable rollers 44 at the inner sides of the holder plates 43. These rollers 44 may be fixedly mounted on the corresponding roller shaft 41. As shown, each of these rollers 44 is provided with a step thereby providing a larger diameter portion 45 and a smaller diameter portion 46. The rollers 44 are provided such that the distance between opposite end surfaces 45*a* of the larger diameter portions 45 corresponds, for example, to the width of B5-sized roll paper 13′. The holder members 40, 40 flank the bottom portions of the holder plates 43, and the rollers 44 are located partly within relief openings 47 provided on both ends and at the bottom of the recess 12.

In the paper storing section A as structured above, two differently sized rolls of paper, e.g., A4 and B5, may be stored selectively. That is, in the case when the roll paper 13 having a larger size A4 is to be stored in the storing section A, the roll 13 is placed on the pair of holder members 40, 40 as riding on the larger diameter portions 45, 45 of the rollers 44, 44. In this case, the roll 13 is inserted between the holder plates 43, 43 and thus the axial movement of the roll 13 is restrained by these holder plates 43, 43, so that the roll 13 is set in position on the pair of holder members 40, 40. On the other hand, in the case when a roll 13′ of paper having the smaller B5 size is to be stored, the roll 13′ is placed on the rollers 44, 44 as riding on the smaller diameter portions 46, 46. In this case, the roll 13′ is fitted between the end surfaces 45*a*, 45*a* of the respective larger diameter portions 45, 45 so that the axial movement of the roll 13′ is restrained by the end surfaces 45*a*, 45*a*, thereby keeping the roll 13′ in position on the holder members 40, 40.

In this manner, differently sized rolls of paper may be properly positioned by the holder members 40, 40 in the paper storing section A. Moreover, with the above-described paper storing section A, prior to the paper feeding operation, the paper is set to be fed in a predetermined paper feeding direction by setting both sides of the roll of paper, and, thus, the paper may be fed to the platen 16 as properly guided when the paper is later fed into the printer section 10.

Thereafter, the leading edge of the roll 13 of paper properly set in the paper storing section A is lead out and guided into the before-mentioned paper supplying section B. On the other hand, when use is made of cut sheets of paper, a cut sheet of paper is directly supplied from the paper supplying section B to the printer section 10.

Figure 5:
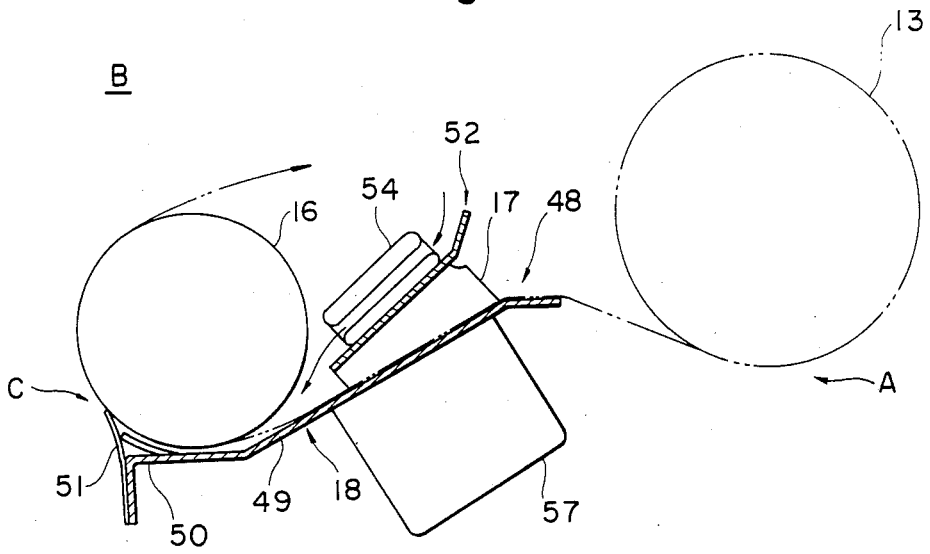
FIG. 5 is a schematic, cross-sectional view showing a paper supplying and guiding section B of the printer of FIG. 2.
Figure 6:
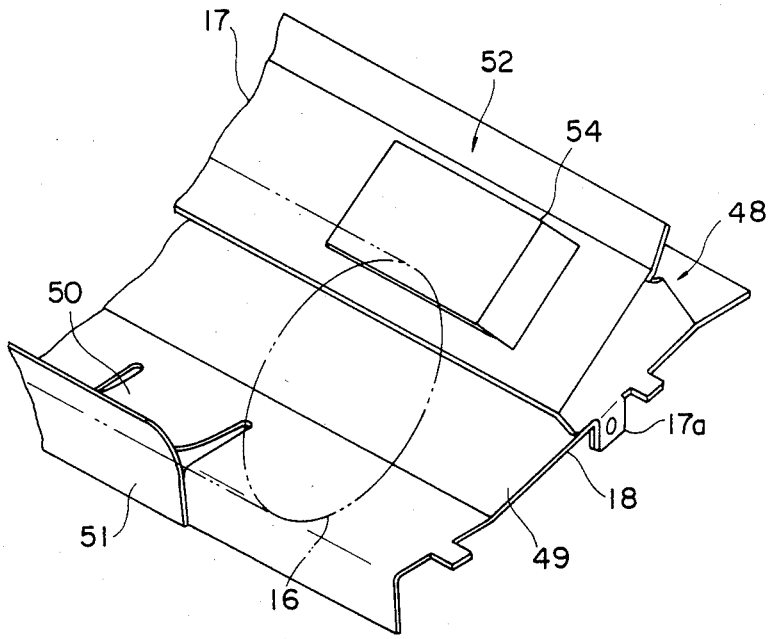
FIG. 6 is a fragmentary, perspective view of the paper supplying and guiding section B.

Now, the paper supplying section B will be described in detail. As shown in FIGS. 5 and 6, the paper supplying section B has a lower guide plate 18 which extends forwardly from a point in the vicinity of the paper storing section A to a point below the platen 16. The lower guide plate 18 has its rear end portion extending reawardly toward the paper storing section thereby defining the roll paper supply port 48 at its entrance. With such a structure, the height of this supply port may be determined slightly above the unwinding point of the roll 13 set in the paper storing section A. Thus, when the paper is unrolled from the roll 13, the roll 13 is prevented from being pulled upward significantly, thereby reduce the tension applied to the paper 13. The lower guide plate 18 also includes an inclined portion 49 which extends along a downslope from the entrance to a position below the platen 16. This inclined portion serves to guide the advancement of the paper fed from the roll 13 to the platen 16 and it also serves to guide the advancement of a cut sheet of paper supplied from the upper guide plate 17. Moreover, the lower guide plate 18 extends further from the bottom end of the inclined portion 49 to the underside of the platen 16, with its forward end portion bent downward at right angles. There is also provided in the lower guide plate 18 an arc-shaped paper guide portion 50 which extends generally in compliance with the outer peripheral surface of the platen 16 from a position opposite to the bottom of the platen 16.

Also provided is a flexible member 51, such as a leaf spring, attached to the bent end portion of the lower guide plate 18. The flexible member 51 is elongated in shape and disposed to extend along the platen 16 with its free end in pressure contact with the platen 16. Thus, as the paper advances with the rotation of the platen 16, its leading edge slidingly passes the contact line between the flexible member 51 and the platen 16. With the provision of the flexible member 51, the paper is prevented from being moved significantly forwardly away from the platen 16, thereby ensure that the paper may be fed in contact with the platen 16.

Figure 7:
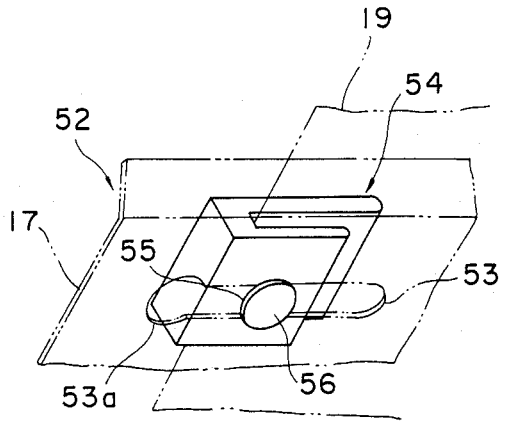
FIG. 7 is a fragmentary, perspective view showing a paper guide for guiding the passage of a cut sheet of paper as mounted on the guide plate of the paper supplying section.

As shown in FIGS. 5 and 6, the upper guide plate 17 is fixedly attached to the lower guide plate 18 at its inclined portion 49. In this case, side portions of the upper guide plate 17 are bent downward and attached to the respective sides of the lower guide plate 18 by means of attaching portions 17*a*. The rear end portion of the upper guide plate 17 is bent upward to define the cut sheet supply port 52 thereby allowing a cut sheet of paper to be supplied easily from above into the upper guide plate 17 as indicated by the arrow. As shown in FIG. 7, the upper guide plate 17 is provided with a pair of holes in the vicinity of the cut sheet supply port 52, only one of which is shown in FIG. 7 and formed as a slot 53. These holes are located spaced apart from each other over a distance corresponding to the width of paper to be used. A cut sheet inserting guide piece 54 is slidably mounted on the upper guide plate 17 is engaged with the slot 53, and another guide piece 54 ( not shown ) is fixedly provided on the upper guide plate 17 is engaged with a circular hole 53 ( not shown ). The guide piece 54 is generally U-shaped and it is preferably comprised of a resin. The guide piece 54 is provided with a mounting portion 56 formed with a groove 55. Thus, the mounting portion 56 may be inserted into a circular opening 53*a* formed at one end of the slot 53, and when the guide piece 54 is moved to the right to bring the groove 56 in engagement with the side edges of the slot 53, the guide piece 54 may be slidable along the slot 53 with some resistance. Thus, the guide piece 54 may be slidingly movable along the slot 53 by applying a somewhat larger force thereto but it may maintain its position due to somewhat tight engagement between the guide piece 54 and the slot 53. Accordingly, the position of the guide piece 54 may be adjustably set in accordance with the width of the paper used.

As described above, the paper supplying section B includes two passages arranged one on the other for different kinds of paper so that roll paper and a cut sheet of paper may be properly supplied. Then, the paper thus supplied advances as guided by the paper guiding mechanism C and is placed around the platen roller 16 from its bottom. That is, as described above, the paper supplied along these two guide plates 17 and 18 is lead to the bottom of the platen 16 by these guide plates 17 and 18 at the same time. Then the paper is guided to move along the peripheral surface of the platen 16 by the paper guiding portion 50 of the lower guide plate 18 to pass between the flexible plate 51 and the platen 16 to be brought into intimate contact with the platen 16. The paper thus partly wound around the platen 16 is then set in position ready for printing by the paper setting mechanism D.

Figure 8:
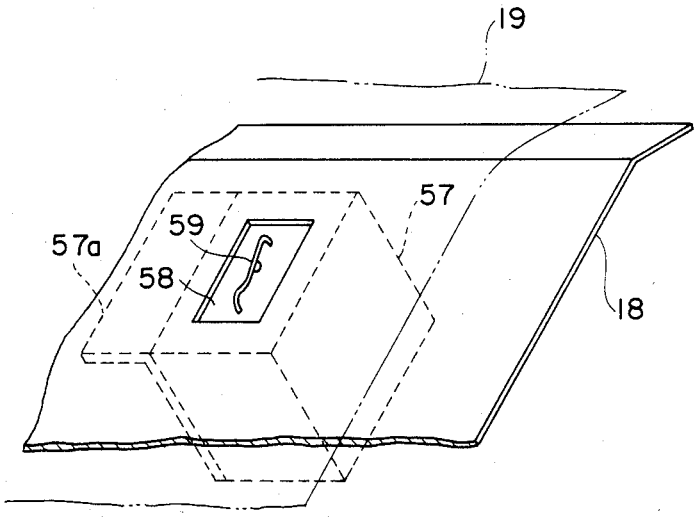
FIG. 8 is a schematic, perspective view showing a paper trailing edge detecting device mounted in the printer of FIG. 2.

As shown in FIG. 5, at the bottom of the inclined portion 49 of the lower guide plate 18 is fixedly attached a paper trailing edge detecting mechanism 57 by means of a mounting bracket 57*a*. As shown in FIG. 8, the paper trailing edge detecting mechanism 57 includes an actuator element 59 which is normally biased to project forwardly through an opening 59 formed in the bottom guide plate 18. Thus, while the paper 19 unwound from the roll 13 is being supplied and thus present on the lower guide plate 18, the paper 19 rides on the actuator element 59 to have it retracted into the detecting mechanism 57. However, if the paper 19 has moved past the lower guide plate 18, the actuator element 59 projects to its advanced position thereby turning an internal switch on to indicate that the paper trailing edge has been detected.

Figure 9:
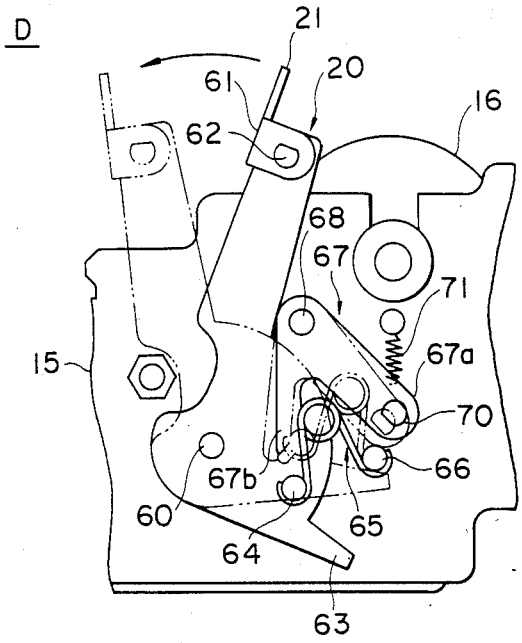
FIG. 9 is a schematic illustration showing a paper setting mechanism of the printer of FIG. 2.

The structure of the paper setting mechanism D will now be described. They are in detail below. The paper setting mechanism D is provided one at each of the side plates 14 and 15 and both of the paper setting mechanisms are identical in structure and associated in operation. Here, the right-hand paper setting mechanism D will be described in detail. As shown in FIG. 9, the paper setting mechanism D includes a pivotally supported paper set lever 20, which is supported at the side plate 15 pivotally around a pivot 60. A holder 61 having the knob 21 is provided at the top end of the lever 20. As shown in FIG. 9, one end of a roller shaft 62 which supports the paper pressing rollers 22 is fitted into the holder 61. The lever 20 is also provided with a projection 63 at its bottom, and an actuating shaft 64 is fixedly mounted on the lever 20 in the vicinity of the projection 63. One end of a toggle spring 65 is attached to the actuating shaft 64, and its the other end is attached to a stopper shaft 66 fixedly planted in the side plate 15. When the actuating shaft 64 is located below the pivot 60 of the lever 20, as indicated by the solid line in FIG. 9, the toggle spring 65 biases the lever 20 to pivot clockwise. In this case, the paper pressing rollers 22 are brought into pressure contact with the platen 16 as indicated by the solid line in FIG. 10.

The side plate 15 is also provided with a generally V-shaped rocking cam 67 adjacent to the lever 20, which cam 67 is pivotally supported by a pivot 68. The roller shaft 70 supporting paper transport rollers 69 disposed below the platen 16 is connected to one end 67*a* of the rocking cam 67. And, a tension spring 71 is provided as extending between the side plate 15 and the end 67*a* of the rocking cam 67 so that the cam 67 is normally biased upward toward the center of the platen 16. Thus, similarly with the paper pressing rollers 22, the paper transport rollers 69 are brought into pressure contact with the platen 16, as indicated by the solid line in FIG. 10. It is to be noted that the tension spring 71 is selected to have a smaller spring force as compared with the toggle spring 65.

Figure 11:
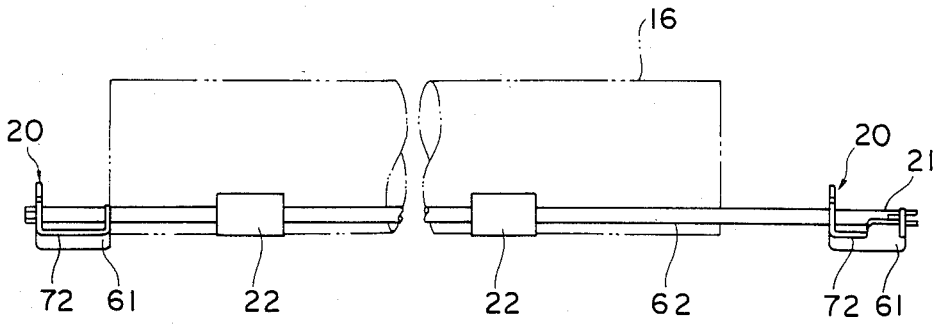
FIG. 11 is a schematic, plan view showing a structure for holding a roller shaft on which the paper pressure rollers are supported.

As shown in FIG. 11, the holder 61 of the paper setting lever 20 provided one at each end of the roller shaft 62 is generally U-shaped and it is securely connected to the roller shaft 62 by providing a connection member 72, for example, of a resin in the holder 61. With such a structure, the paper setting levers 20 on both sides are firmly connected through the roller shaft 62. Accordingly, in a paper setting operation, if one of the levers 20, for example the right-hand lever, is pivotted as will be described later, both of the levers 20 pivot at the same time through the roller shaft 62 to thereby operate the paper setting mechanisms D on both sides in an associated manner.

Now, if it is desired to set the paper around the platen 16 by means of the above-described paper setting mechanism D, the knob 21 of the lever 20 is grabbed and to have the lever 20 pivotted in the counterclockwise direction as indicated by the arrow in FIG. 9 thereby causing the paper pressing rollers 22 to be separated away from the platen 16. Then, the lever 20 is pivotted until its projection 63 comes into engagement with the stopper shaft 66, as indicated by the two-dotted line in FIG. 9, which may be called an inclined position. With the lever 20 at the inclined position, the actuating shaft 64 comes to be located above the pivot 60 of the lever 20, so that the lever 20 is urged to pivot in the counterclockwise direction by means of the toggle spring 65. However, the further pivotal motion of the lever 20 is restrained due to engagement with the stopper shaft 66 so that the lever 20 comes to be maintained in the inclined position. In this case, since the actuating shaft 64, which moves along with the pivotal motion of the lever 20, pushes the other end 67*b* of the rocking cam 67, the rocking cam 67 pivots clockwise around the pivot 68 against the force of the tension spring 71. Thus, as indicated by the two-dotted line in FIG. 10, the paper transport rollers 69, which have so far been pressed against the platen 16, also somewhat move away from the platen 16 together with the paper pressing rollers 22.

Figure 10:
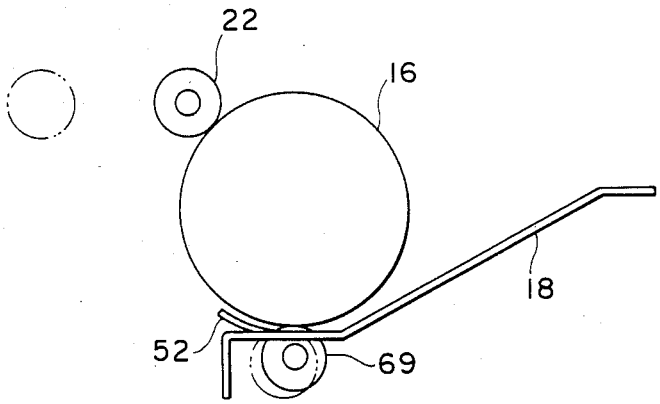
FIG. 10 is a schematic illustration showing how a paper pressure roller and a paper transport roller are moved with respect to a platen roller in the printer of FIG. 2 by operating the paper setting mechanism of FIG. 9.

In this manner, with the paper pressing rollers 22 and the paper transport rollers 69 temporarily located separated away from the platen 16, as shown in FIG. 10, the paper is lead into underside of the platen 16 by hand and moved between the flexible plate 51 and the platen 16 to cause the paper partly wound around the platen 16.

Then the paper set lever 20 is pivotted clockwise against the force of the toggle spring 65. When the lever 20 is pivotted in this manner, the actuating shaft 64 comes to be disengaged from the end 67*b* of the rocking cam 67, so that the rocking cam 67 is pivotted clockwise under the influence of the tension spring 71 thereby returning to its original position as indicated by the solid line in FIG. 9. Thus, as indicated in FIG. 10, the paper pressing rollers 22 and the paper transport rollers 69 are brought into pressure contact with the platen 16 to press the paper thereby completing setting of paper to the platen 16 to establish a condition ready to carry out printing.

Figure 12:
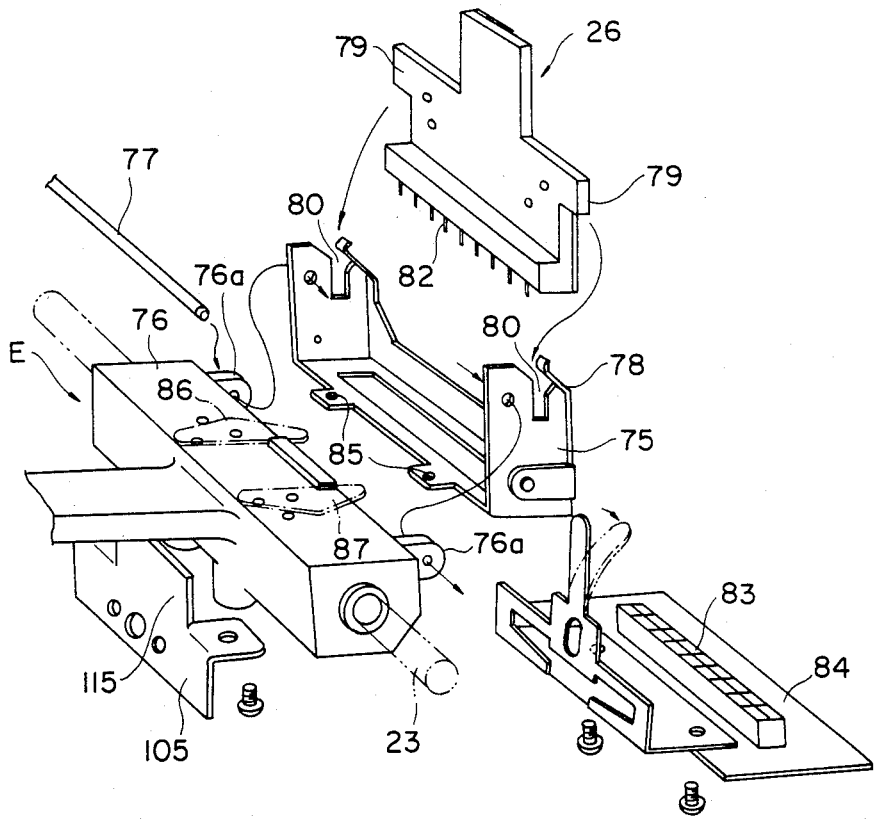
FIG. 12 is an exploded, perspective view showing a carriage mounted in the printer of FIG. 2.
Figure 13:
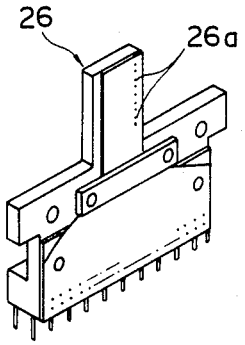
FIG. 13 a perspective view showing a thermal printhead mounted on the carriage of FIG. 12.

With particular reference to FIGS. 12 and 13, the structure of carriage E will be described in detail below. As shown in FIG. 12, the thermal printhead 26 is mounted on a head holder 75, which is pivotally supported to brackets 76*a*, 76*a* of a carriage block 76 through a mounting shaft 77. The head holder 75 is provided with a head holding spring 78 which prevents the thermal printhead 26 from being detached from the holder 75 unintentionally. Described in greater detail, the thermal printhead 26 is provided with a pair of shoulder portions 79, 79 which may be fitted into cutaway portions 80, 80 from above and, when inserted, which may engage with the head holding springs 78, 78 thereby preventing unintentional detachment. As shown in FIG. 13, the thermal printhead 26 has a front surface, which faces the platen 16 and which is provided with an appropriate number of heat-producing elements 26*a* arranged in a line spaced apart one from another for printing characters in the form of a dot matrix on recording paper.

Below the head holder 75 is disposed a later described flexible member for pivotting the head holder 75 itself counterclockwise as viewed into FIG. 12 and a base 84 provided with a connector 83 into which connector pins 82 of the thermal printhead 26 set in the head holder 75 may be inserted, which are fixedly attached to the holder 75 through engagement between screws and threaded holes 85, 85. The connector 83 is connected to a flexible printed plate as will be described in detail later.

Figure 14:
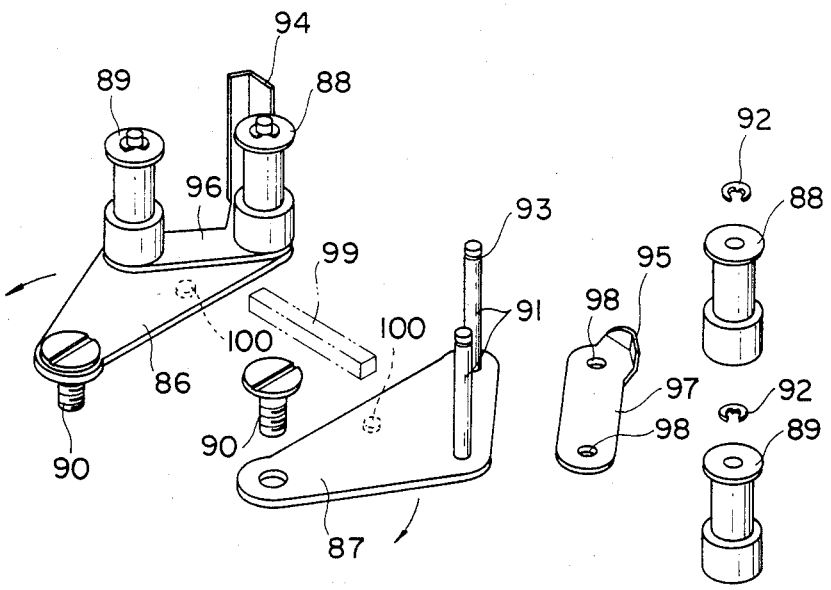
FIG. 14 is a partly exploded, perspective view showing pivotal arms mounted in the carriage of FIG. 12.
Figure 15:
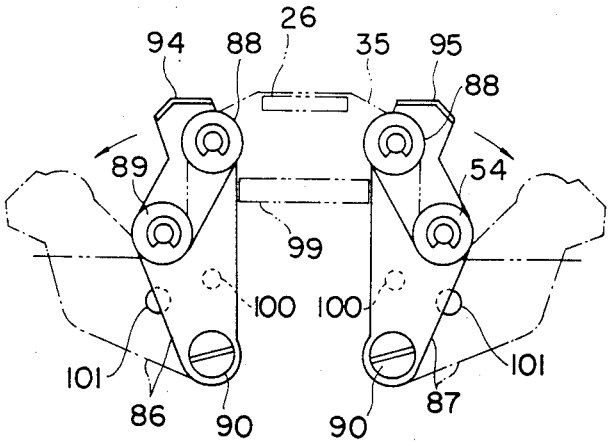
FIG. 15 is a plan view of the pivotal arms shown in FIG. 14.

As indicated by the one-dotted lines in FIG. 12, a pair of pivotal arms 86 and 87 are mounted on the carriage block 76. As shown in FIGS. 14 and 15, these pivotal arms 86 and 87 carry ribbon guide rollers 88 and auxiliary rollers 89 which guide the heat-sensitive ribbon 35 between the thermal printhead 26 and the platen 16. As is obvious from FIG. 14, the ribbon guide rollers 88 and auxiliary rollers 89 are mounted on the pivotal arms 86 and 87 as fitted onto pins 91 which are fixedly planted in the pivotal arms 86 and 87. These pivotal arms 86 and 87 are pivotally movable to the left and to the right horizontally on the carriage E around respective pivots 90. The pins 91 are provided with grooves 93 at their top ends, into which ring members 92 may be fitted. Each of the rollers 88 and 89 is mounted to be rotatable around the corresponding fixed pin. The pivotal arms 86 and 87 are provided with guide members 96 and 97, respectively, which are provided with holes 98 corresponding in position to the fixed pins 91, so that the guide members 96 and 97 may be held in position through engagement between the pins 91 and the holes 98. The guide members 96 and 97 are provided with paper guides 94 and 95 which will be described in greater detail later.

Thus, the guide members 96 and 97 are first placed on the pivotal arms 86 and 87 with the pins 91 fitted into the corresponding holes 98 and then the rollers 88 and 89 are fitted onto the pins 91. Then, the ring members 92 are snapped into the grooves 93 to prevent them from being dismounted.

The pivotal arms 86 and 87 are mounted on the top surface of the carriage E by the pivots 90, 90 such that they are arranged symmetrically on both sides of the thermal printhead 26. The ribbon guide rollers 88 and 88 are positioned to be close to both sides of the thermal printhead 26 as shown in FIG. 15.

The pivotal arms 86 and 87 may be pivotally moved around the respective pivots 90, 90 by hand to the right or to the left, and they are normally held to be in contact with both ends of a stopper 99 provided on the carriage E. When located at these stop positions, click stoppers 100, 100 projecting downward from the bottom surfaces of the pivotal arms 86, 87 are engageable with recesses at the carriage side, so that the pivotal arms 86 and 87 are prevented from freely pivotting. On the other hand, when the pivotal arms 86 and 87 are pivotally moved to the positions indicated by the two-dotted lines, these click stoppers 100, 100 are engageable with recesses 101, 101. The reason why the arms 86 and 87 are pivotally provided is to facilitate replacement because the thermal printhead 26 is relatively short in service life.

Figure 16:
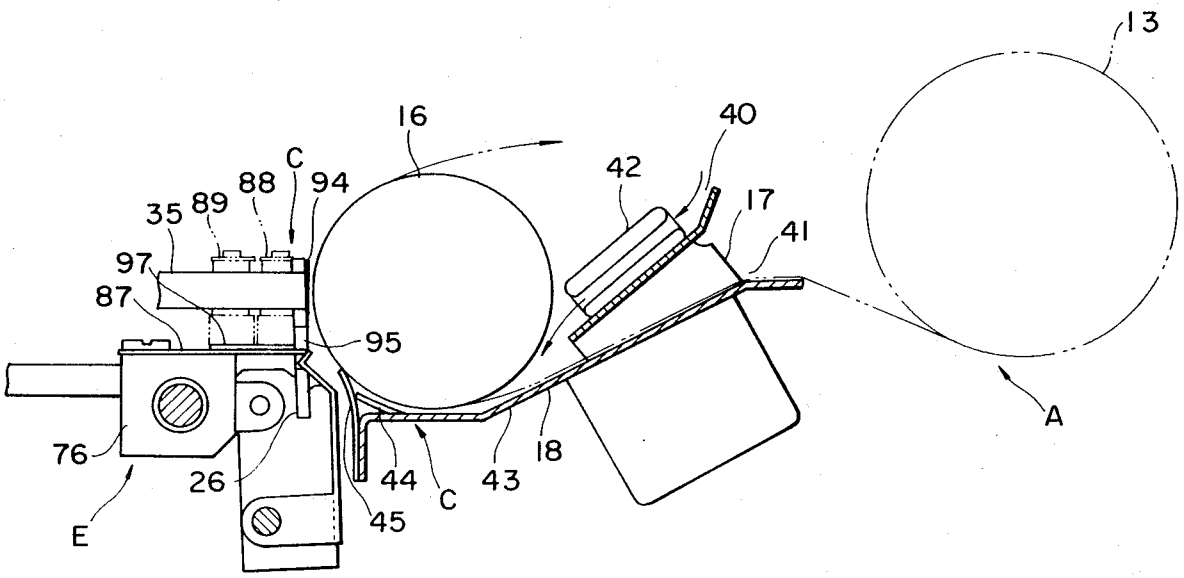
FIG. 16 is a schematic, illustration showing a paper guide mechanism of the printer of FIG. 2.
Figure 17:
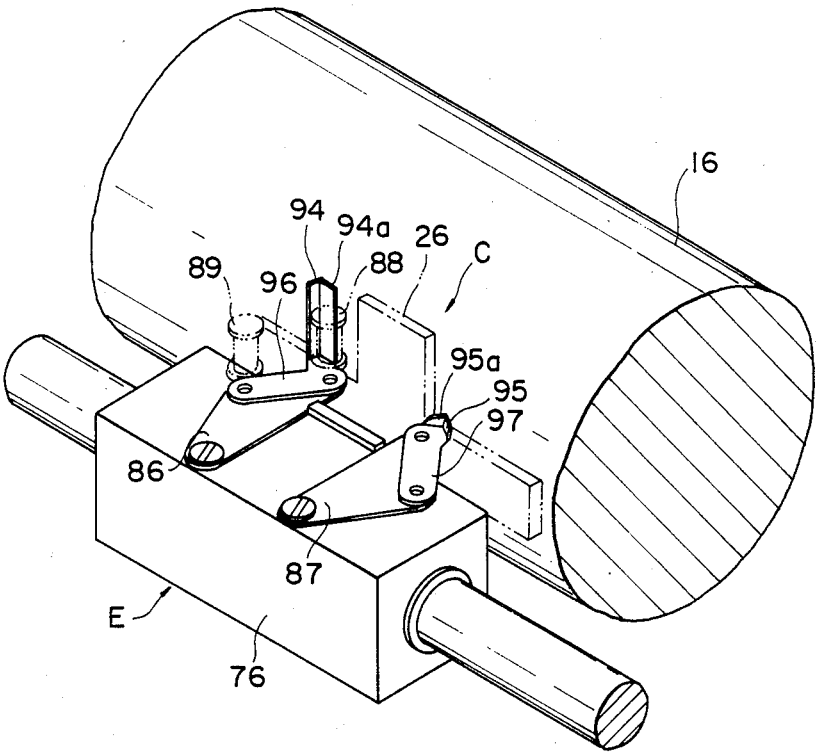
FIG. 17 is a schematic, illustration showing a pair of paper guides for guiding the advancement of paper in front of the platen in the printer of FIG. 2.

The paper guides 94 and 95 will now be described. They are formed in the guide members 96 and 97 mounted on these pivotal arms 86 and 87, respectively. As shown in FIGS. 16 through 19, these paper guides 94 and 95 are located at the far ends of the pivotal arms 86 and 87 and on both sides of the thermal printhead 26. As shown in FIG. 16, these paper guides 94 and 95 extend slightly more toward the platen 16 than the thermal printhead 26 in a paper setting condition in which the thermal printhead 26 is separated away from the platen 16. As shown in FIG. 17, these paper guides 94 and 95 are angled to form guide portions 94*a* and 95*a*, which are the portions opposite to the thermal printhead 26, for guiding the advancement of the paper.

Figure 18:
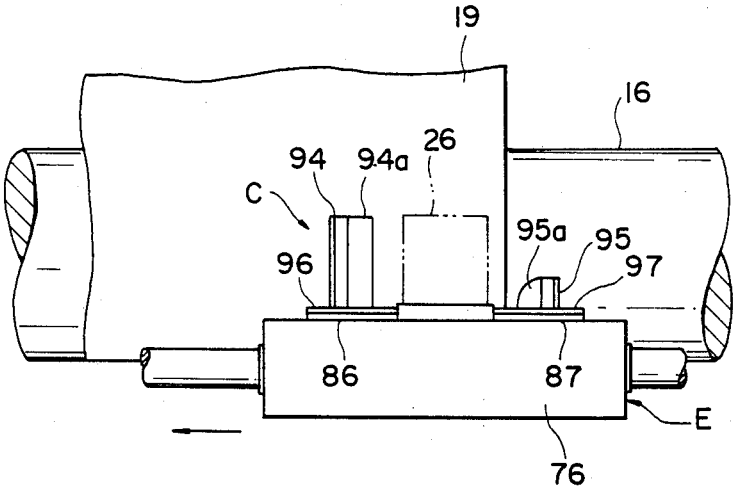
FIG. 18 is a schematic, plan view useful for understanding the operation of the paper guides while the carriage is moving in the direction indicated by the arrow.

Among these two paper guides 94 and 95, the paper guide 94 extends vertically beyond the center line of the platen 16, as shown in FIG. 18. On the other hand, the other paper guide 95 is shorter than the paper guide 94 and terminates short of the center line of the platen 16. The guide portion 95*a* of the right-hand paper guide 95 is rounded to provide an arc-shaped end face. Thus, when paper is to be placed around the platen 16, the paper is fed along the platen 16 and is guided by the guide portions 94*a* and 95*a* such that the paper does not interfere with the heat-sensitive ink ribbon 35 present between the platen 16 and the thermal printhead 26 so that the paper may be placed around the platen 16. In this manner, the paper guides 94 and 95 serve to guide the advancement of the paper in front of the platen 16 and cooperate with the paper guiding mechanism C provided below the platen 16 thereby forming as a whole a paper feed guiding mechanism.

As described above, since the guide portion 95*a* is rounded, when the paper guide 95 starts to move to the left as indicated by the arrow after having been located to the right of the paper 19 upon completion of printing along a single line from the left to the right, as shown in FIG. 18, the rounded guide portion 95*a* scoops the paper 19. Thus, the paper guide 95 is prevented from interfering with the paper 19 while the carriage E executes a reciprocating motion along the platen 16.

Figure 19:
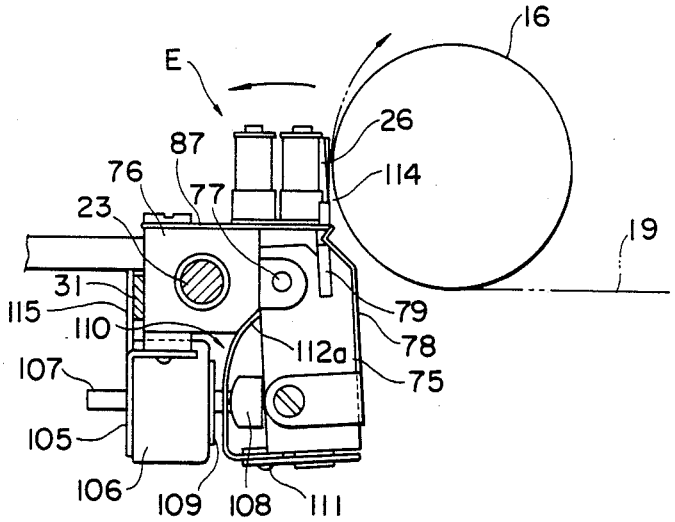
Figure 20:
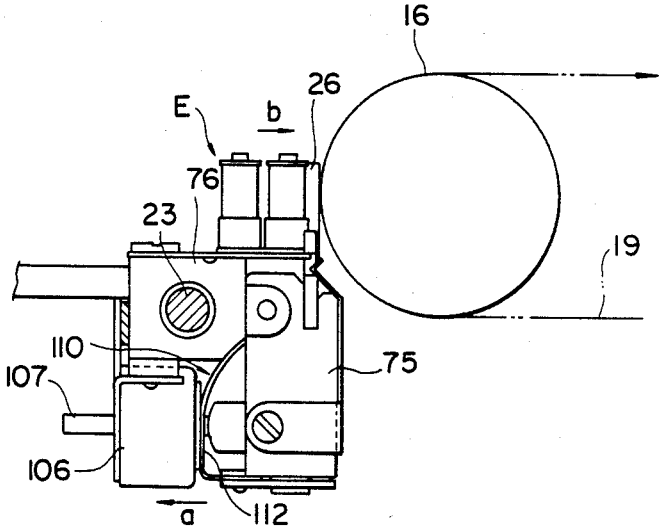

As shown in FIGS. 19 and 20, below the carriage block 76, on which the pivotal arms 86 and 87 are mounted, is disposed the head pressing mechanism. In this thermal printer, the thermal printhead 26 is pivotally moved toward or away from the platen 16 by the head pressing mechanism so that the head 26 is pressed against the platen 16 when printing is to be effected and the head 26 is moved away from the platen 16 when paper and/or ink ribbon is to be set.

Figure 21:
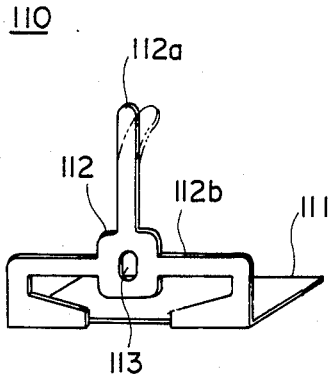
FIGS. 21 and 22 are schematic, perspective views each showing a flexible member provided in the pressing mechanism shown in FIGS. 19 and 20.

As shown in FIG. 19, the head pressing mechanism includes a solenoid holder 105 disposed below the carriage block 76 and a solenoid 106 is received in the solenoind holder 105. The solenoid 106 includes an actuating lever 107 provided with a pulling member 108 at its forward end. It is so structured that the actuating lever 107 is retracted when the solenoid is energized. And, in the rear of the thermal printhead 26 and between the pulling member 108 of solenoid 106 and a mounting plate 109 mounted on the actuating lever 107 is provided a flexible member 110, such as a leaf spring. As an example, the flexible member 110 has a structure as shown in FIG. 21. The flexible member 110 includes a mounting portion 111 and a flexible portion 112 which extends vertically upward as bent from the mounting portion 111. The flexible portion 110 includes a first flexible portion 112*a* which extends upward in the form an elongated tongue and a second flexible portion 112*b* which is formed by cutting away portions between the first flexible portion 112*a* and the mounting portion 111 to have a stronger flexibility than the first flexible portion 112*a*. This flexible member 110 is provided with a hole 113 between the first and second flexible portions 112*a* and 112*b*, through which the actuating lever 107 extends. As shown in FIG. 19, the flexible member 111 has its mounting portion 111 fixedly attached to the bottom of the head holder 75 with the free end of the first flexible portion 112*a* pressed against the carriage block 76. In this case, the flexible member 110 is so structured that only the first flexible portion 112*a* flexes as indicated by the two-dotted line in FIG. 21. Under the normal condition in which the solenoid 106 is deenergized, as shown in FIG. 19, the flexible member 110 biases the thermal printhead 26 to pivot counterclockwise by the first flexible portion 112*a*.

Accordingly, when the thermal printhead 26 is to be moved away from the platen 16 prior to a printing operation in the present head pressing mechanism, the solenoid 106 is kept deenergized. In this case, as shown in FIG. 19, due to a couterclockwise bias force by the first flexible portion 112*a* of the flexible member 110 pressed against the carriage E, the thermal printhead 26 is pivotted counterclockwise as indicated by the arrow in FIG. 19 to be positioned inclined with a gap 114 formed between the platen 16 and the head 26. This gap 114 is used to set the paper 19 around the platen 16 by passing under the platen 16 or to set the ink ribbon in position.

Figure 22:
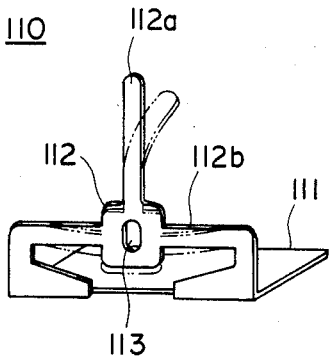

Thereafter, in order to bring the head 26 pressed against the platen 16 to carry out printing, the solenoid 106 is energized to retract the actuating lever 107 thereby causing the flexible portion 112 of the flexible member 110 to be pulled toward the solenoid 106 as indicated by the arrow a in FIG. 20. In this manner, when the flexible portion 112 is pulled, the head 26 is pivotted clockwise around its pivotal point as indicated by the arrow b in FIG. 20 to be pressed against the paper 19 on the platen 16. In this case, as indicated by the two-dotted line in FIG. 22, the second flexible portion 112*b* of the flexible member 110 is also bent toward the solenoid 106. Since the second flexible portion 112*b* is stiffer than the first flexible portion 112*a*, the second flexible portion 112*b* overcomes the first flexible portion 112*a* to apply counterclockwise bias to the head 26, so that the head 26 is further pressed against the platen 16 as shown in FIG. 20. Then, the heat-producing elements of the head 26 are heated momentarily to form burn points in the form of desired characters on the paper 19 around the platen 16.

As shown in FIGS. 12 and 19, the tongue 115 integrally provided with the solenoid holder 105 holds the carriage belt 31 sandwiched between the tongue 115 and the block 76 thereby connecting the belt 31 to the block 76. With this connection, the carriage E moves together with the belt 31.

As described above, in the present head pressing mechanism, use is made of the flexible member 110 having the two flexible portions 112*a* and 112*b* which are different in the degree of flexibility to apply a bias force to the head 26 in one direction to move the head 26 closer to or away from the platen 16. In the present thermal printer, the carriage E as a whole including the head pressing mechanism is driven by the carriage driving mechanism F thereby moving horizontally along the platen 16 as guided by the guide shaft 23 to effect printing on the paper.

Next, the carriage driving mechanism F, including the pulley holding structure will be described. As shown FIG. 23, the carriage driving mechanism includes a carriage driving motor 27 disposed on a bottom plate 116. The rotation of this motor 27 is transmitted to the driver pulley 30 and to the follower pulley 29 at the side of the motor 27 through carriage driving gear train 28. Then the belt 31 extended between these pulleys 29 and 30 is caused to advance thereby causing the carriage E fixed to the belt 31 to move in the printing direction indicated by the arrow c as guided by the guide shaft 23 to effect printing along a line on the paper. Upon completion of printing for that line, the motor 27 is driven to rotate in the reversed direction to bring the carriage to the original position to the left in FIG. 23 by the driving mechanism F. The carriage E is moved back and forth by repetitively carrying out the above-described steps to effect printing line after line on the paper 19.

Figure 23:
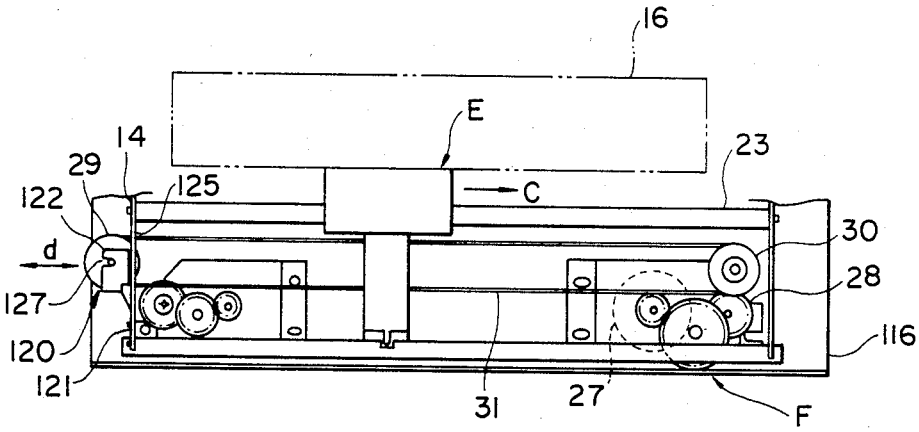
FIG. 23 is a schematic, plan view showing a pulley holding structure in the carriage driving mechanism.
Figure 24:
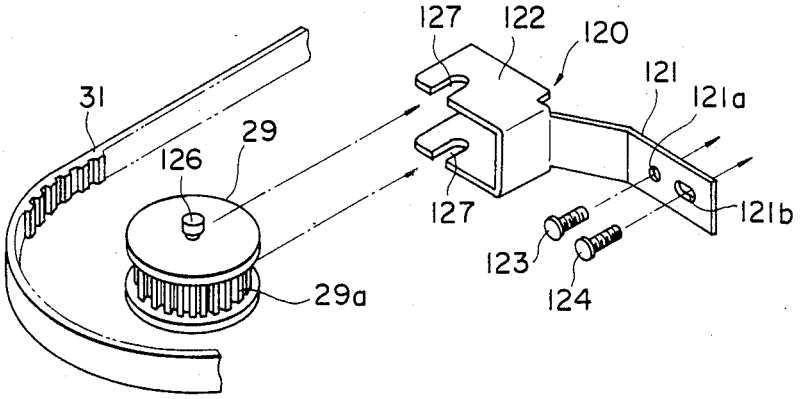
FIG. 24 is an exploded, perspective view of the pulley holding structure.

As shown in FIG. 23, the left-hand side plate 14 is provided with a holding member 120 for holding the follower pulley 29. As also shown in FIG. 24, the holding member 120 includes a mounting portion 121, which has an appropriate rigidity and which is attached to the side plate 14, and a generally U-shaped holding section 122 which extends from the mounting portion 121 as bent somewhat to the outside. The mounting portion 121 is provided with a mounting hole 121*a* and a slot 121*b* adjacent thereto. Thus, the holding member 120 is mounted on the side plate 14, for example, by screws 123 and 124 threaded through the respective holes 121*a* and 121*b*. With the holding member 120 mounted on the side plate 14, the holding portion 122 is formed to have flexibility in the direction indicated by the arrow d in FIG. 23 depending on the tension condition of the belt 31. The follower pulley 29 is rotatably held in the holding portion 122. The side plate 14 is provided with a relief opening 125 so as not to hinder the operation of the follower pulley 29 due to a flex motion of the holding member 120. As shown in FIG. 24, the follower pulley 29 is provided with a pulley shaft 126 at its center and has a frictional surface 29*a* on its outer peripheral surface, around which the belt 31 passes, and the frictional surface 29*a* is in the form of serration so as to provide secure transmission of power. The follower pulley 29 is held in the holding member 120 with its pulley shaft 126 fitted into cut-away portions 127, 127 formed in the holding portion 122.

Accordingly, in the carriage driving mechanism F including the pulley holding structure, when the motor 27 is driven to rotate to advance the belt 31 thereby moving the carriage E in the direction indicated by the printing direction c, even if there is produced a slack in the belt 31 between the carriage E and the follower pulley 29, the elasticity of the holding member 120 holding the follower pulley 29 causes the belt to move away from the driver pulley 30 thereby removing the slack instantly. On the contrary, even if the belt 31 is placed under an excessive tension, the elasticity of the holding member 120 helps to relax the tension. Thus, the belt 31 may be maintained at a predetermined tension condition at all times.

In order to carry out a printing operation, the heat-producing elements 26*a* of the head 26 must be selectively heated while the carriage E is in motion from the left to the right. And, while the carriage E moves from the right to the left to its home position, the solenoid 106 must be energized to move the head 26 away from the platen 16. Thus, it is necessary to establish an electrical connection between the carriage and electronics circuit portions to carry out required controls. However, the electronics circuits are disposed in the rear of the printer section 10 and immediately below the paper storing section A; on the other hand, the carriage E executes a reciprocating motion along the platen 16, so that an electrical connection therebetween is established by a flexible printed plate 130, as shown in FIG. 25.

The flexible printed plate 130 is elongated in shape and constant in width and it is provided with a carriage connecting end 131 to be connected to the carriage E and a fixed connecting end 132 to be connected to the printer section 10 on both ends. The illustrated flexible printed plate 130 is of the one side mounting type and it has a mounting side X and a solder side Y. As shown in FIGS. 25 through 27, on the mounting side X at the carriage connecting end 131 is mounted a connector 83 for connection with the thermal printhead through the base 84 described previously and a connector 133 for connection with the solenoid 106, which are soldered on the solder side Y.

Figure 25:
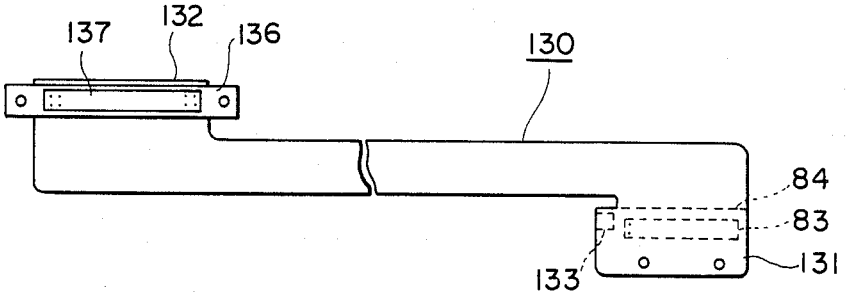
FIG 25 is a plan view showing a flexible printed plate for use in the printer of FIG. 2.
Figure 26:
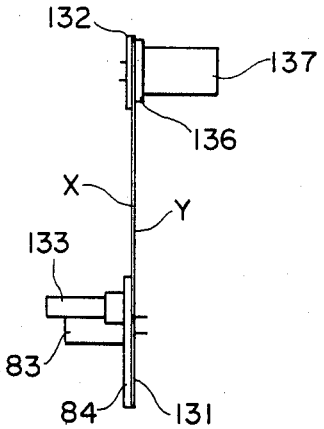
FIG. 26 is a left-hand side view of the flexible printed plate.
Figure 27:
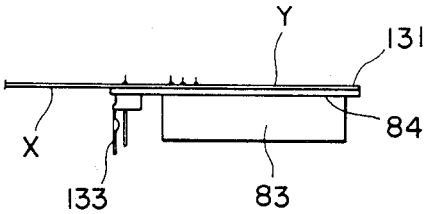
FIG. 27 is a front view showing the carriage connection end of the flexible printed plate.
Figure 28:
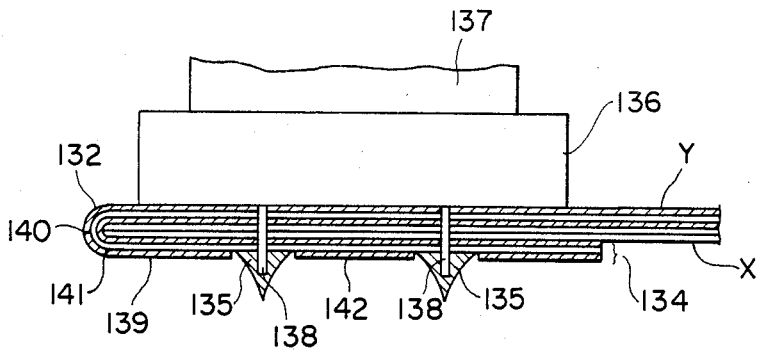
FIG. 28 is an enlarged cross-sectional view showing the main body fixture end of the flexible printed plate.

On the other hand, as shown in FIGS. 25, 26 and 28, the fixed connecting end 132 is folded back over a length to enclose the mounting surface X, as best shown in FIG. 28, and a plurality of through-holes 135 are provided extending from the original solder surface Y to the opposite solder surface of the folded back portion 134. A connector 137 for connection with the electronics circuits is mounted on the solder side Y through a mounting plate 136 with legs 138 extending from the connector 137 fitted into the respective through-holes 135 and the legs 138 are connected to a copper foil 139 by soldering on the solder surface Y of folded back portion 134. The copper foil 139 is provided on a base film 140 with an adhesive 141 therebetween, and a cover film 142 is provided for protection. Thus, the base film 140 side defines the mounting side X and the cover film 142 side defines the solder side Y.

Figure 29:
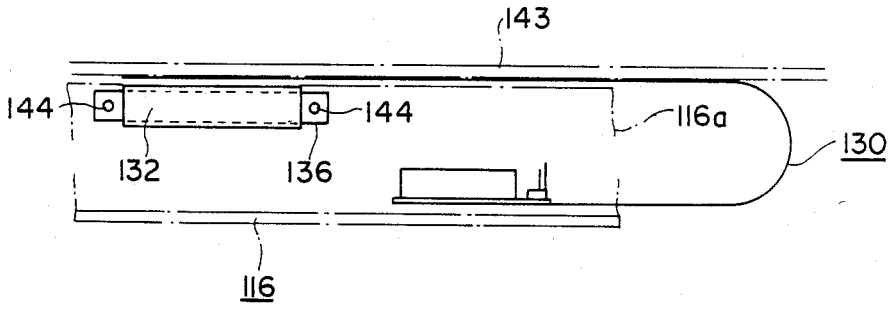
FIG. 29 is a schematic illustration showing the use condition of the flexible printed plate.

The flexible printed plate 130 is bent as shown in FIG. 29 and it is placed generally between the bottom plate 116 of the printer section 10 and a plate 143 which is disposed below the paper guiding section C and in parallel with and spaced apart over a predetermined distance from the bottom plate 116. The carriage connecting end 131 is connected to the carriage E, as described above. On the other hand, the fixed end 132 is bend downward and fixedly attached to a vertical wall 116*a* which extends upright from the bottom plate 116 by screws which extend through mounting holes 144 of the mounting plate 136 with the connector directed rearward. Then, a connector from the electronics circuit portion is connected to the connector 137 thereby establishing an electrical connection between the carriage E and the electronics circuit portion.

Figure 30:
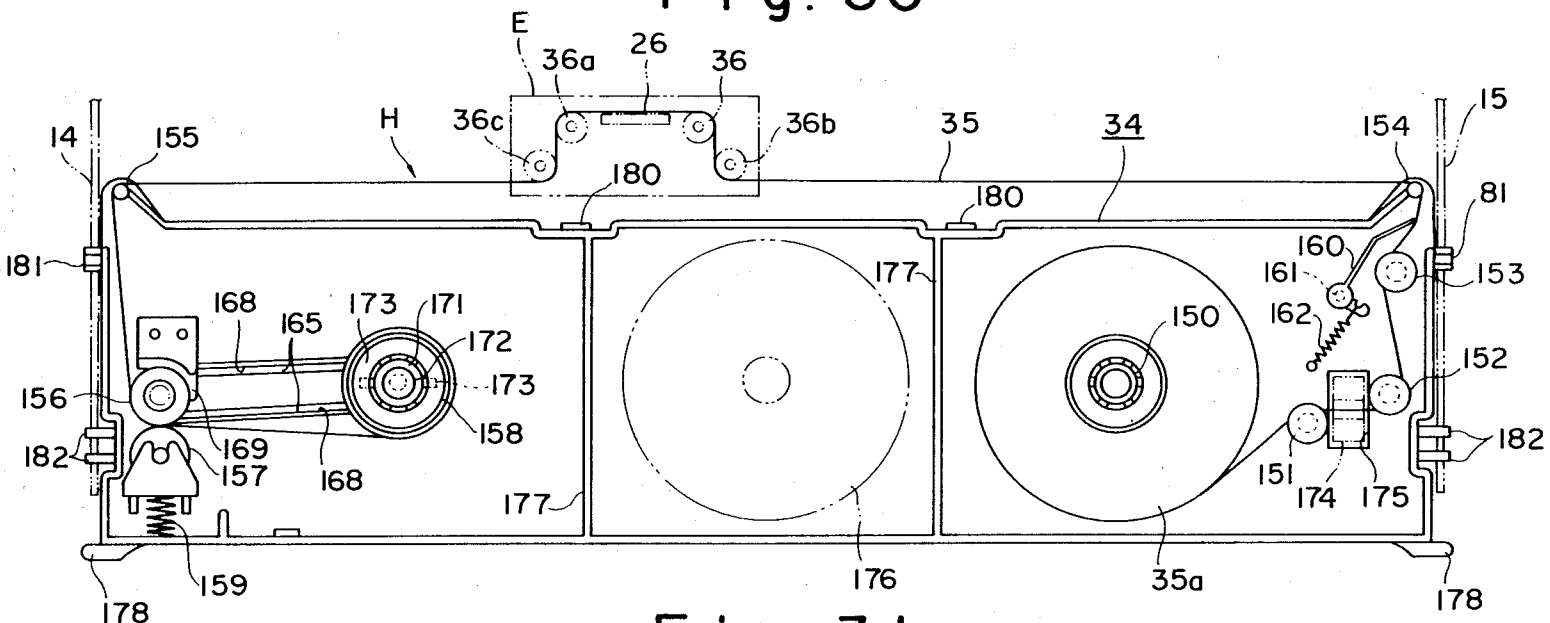
FIG. 30 is a plan view on an enlarged scale showing the internal structure of the ribbon cassette with its top cover removed.
Figure 31:
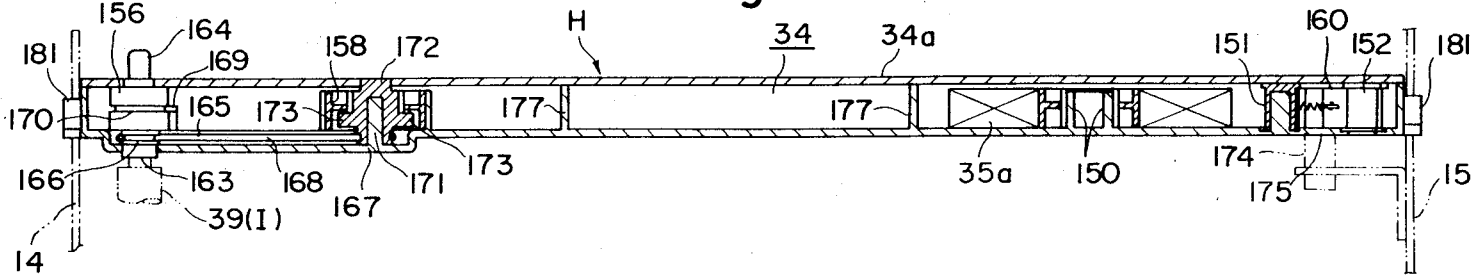
FIG. 31 is a longitudinal cross-sectional view of the ribbon cassette with its top cover mounted in position.

It will now be described as to the structure of the ribbon cassette H in detail below. As shown in FIGS. 30 and 31, the ribbon cassette H includes the cassette main body 34 which contains therein a roll 35*a* of heat-sensitive ink ribbon. The ink ribbon roll 35*a* is rotatably supported by a shaft 150 and the ribbon 35 unwound from the roll 35*a* leads to a supply guide 154 after passing through guide rollers 151, 152 and 153. The ink ribbon 35 extends exterior of and approximately over the entire longitudinal length of the main body 34 from the supply guide 154 to a take-up guide 155 provided at the side opposite to the side where the supply guide 154 is provided. The ribbon 35 further extends between a driving roller 156 and a pinch roller 157 to a take-up spool 158. The pinch roller 157 is pressed against the driving roller 156 by means of a spring 159.

Provided between the supply guide 154 and the guide roller 153 is a tension lever 160 which prevents the ribbon 35 extending between the supply guide 154 and the take-up guide 155 from being slackened. The tension lever 160 is pivotted at a pivot 161 and normally biased clockwise by a spring 162 so that its tip end is pressed against the ribbon 35 to apply a predetermined tension to the ribbon 35.

The driving roller 156 is provided at its bottom with a connecting portion 163 which may be connected in a rotational force transmitting relation to the driving shaft 39 of the ribbon driving mechanism I. The driving roller 156 is also provided with a knob 164 at its top, which may be operated by fingers to rotate the roller 156. The driving roller 156 is further provided with a pulley 166 around which an endless belt 165 for rotating the take-up spool 158 is passed around. As best shown in FIG. 31, the pulley 166, belt 165 and a pulley 167 at the side of the take-up spool 158 are disposed within a recess 168 provided at the bottom of the cassette main body 34. A slider 169 is provided to be in sliding contact with the driving roller 156 for preventing the ribbon 35 from being wound around the driving roller 156, and, for this purpose, the slider 169 has its forward end engaged in a groove 170 formed in the driving roller 156.

There is provided a fixed shaft 171 in the recess 168 and the take-up spool 158 includes a rotating portion 172 which is provided with the pulley 167 and which is rotatably fitted onto the shaft 171. Pawls 173 are provided in the rotating portion 172 and the take-up spool 158 which is detachably mounted on the rotating portion 172 is structured to be engageable with these pawls 173. The amount of ribbon to be wound up by the take-up spool 158 varies as the diameter of a ribbon roll wound around the take-up spool 158 increases; however, the amount of ribbon to be fed by the driving roller 156 is adjusted by a slippage with the belt 165.

The cassette main body 34 is so structured that a ribbon end detector 174 may be located in the vicinity of the unwinding point of the roll 35*a*. The detector 174 is provided, for example, as mounted on the side plate 15 of the printer section 10 by means of brackets. And, when the ribbon cassette H is set in position in the printer section 10, the detector 174 projects into the interior of the cassette main body 34 to be located closer to a passage of ink ribbon 35 unwound from the roll 35*a* through an opening 175 provided in the bottom wall of the main body 34.

A reserve ribbon roll 176 is provided in a compartment formed by partition walls 177 generally at the center of the main body 34. It is to be noted that another shaft similar to the shaft 150 may also be provided in this compartment, and, in this case, the partition walls 177 may be discarded. This reserve roll 176 may be fitted onto the shaft 150 after using the roll 35*a*, or, if the reserve roll 176 is supported by a shaft, it may be directly lead out to the roller 151. In the latter case, it is preferable to provide an appropriate number of guide rollers between the roll 176 and the roller 151.

Figure 32:
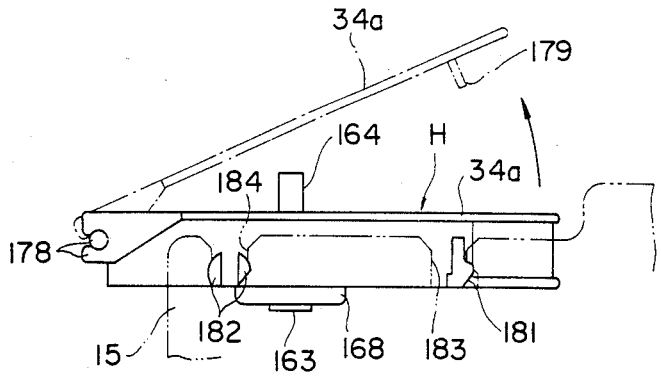
FIG. 32 is a right-hand side view of the ribbon cassette.

The cassette main body 34 is illustrated with its top cover 34*a* removed in FIG. 30. The top cover 34*a* may be detachably mounted on the cassette 34 through hinge portions 178, 178. As shown in FIG. 32, a pair of hooks 179 is provided on the top cover 34*a*, and these hooks 179 are engageable with notches 180 provided in the main body 34.

Mounting of the ribbon cassette H to the printer section 10 is carried out by having engaging projections 181, 182 provided on both sides of the cassette main body 34 engaged with engaging recesses 183, 184 provided in the side plates 14 and 15. When so mounted, the driving roller 156 of ribbon cassette H comes to be set in driving connection to the driving shaft 39 of the ribbon driving mechanism I of the printer section 10. Of course, the detector 174 also projects into the interior of the cassette H through the opening 175, as described previously.

Figure 33:
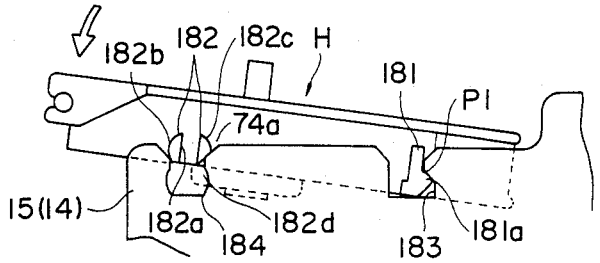
FIGS. 33 and 34 and are schematic illustrations useful for explaining how the ribbon cassette is mounted in position in the printer of FIG. 2.
Figure 34:
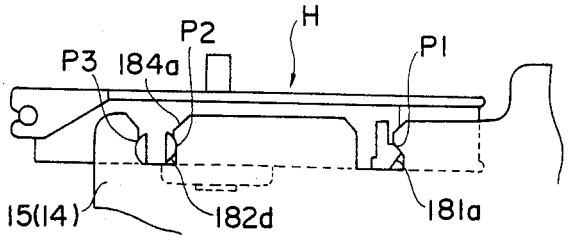

As shown in FIG. 33, when the ribbon cassette H is to be mounted in position, in the first place, the first engaging projections 181 are inserted into the first engaging recesses 183 from above. In this case, the ink ribbon located exteriorly of the cassette main body 34 extends in tension between the supply and take-up guides 154 and 155. Then, the front side of the cassette main body 34 is pressed downward to cause the second engaging projections 182 fitted into the second engaging recesses 184 from above. In this event, a hook portion 181*a* of the first engaging projection 181 comes into abutment against a shoulder point P1 of the first engaging recess 183 so that the first engaging projection 181 is brought into complete engagement with the first engaging recess 183. On the other hand, the second engaging projection 182 is fork-shaped and its hook portions 182*b* and 182*c* defined by a center cut 182*a* are brought into engagement with the second engaging recess 184. The second engaging projection 182 in this case is snapped into the recess 184. When snapped into the recess 184, the hook portions 182*b* and 182*c* come into abutment against shoulder points P2 and P3, respectively.

The hook portion 182*c* is provided with a cut surface 182*d* which allows to reduce a resistive force when the second engaging portion 182 is to be pressed into the second engaging recess 184 with the cassette H pivotally moved around the contact between the first engaging projection 181 and the shoulder portion P1. An inclined surface 184*a* is provided in the side plate 15 (14) as connected to the recess 184 so that the cut surface 182*d* slides along the inclined surface 184*a* when the second engaging projection 182 is to be fitted into the second engaging recess 184, so that mounting of the cassette H may be carried out smoothly.

Upon mounting of the cassette H as described above, the ribbon 35 extending outside of the cassette main body 34 is passed around the thermal printhead 26 of the carriage E, ribbon guide rollers 36 and 36*a* and auxiliary rollers 36*b* and 36*c*, for example, as shown in FIG. 30. This operation may be carried out such that the ribbon 35 is pulled out by unwinding the roll 35*a* and setting or the ribbon 35 is carried out manually. Then, the knob 164 is rotated to take up a slackened portion of the ribbon 35 to the take-up spool 158.

The illustrated embodiment is so structured that when a print start switch is turned on, the carriage E returns to its initial position and, in association therewith, the ribbon driving mechanism I starts to be driven so that the initial slack in the ribbon 35 produced when set may be automatically removed. The ribbon driving mechanism I is driven intermittently in synchronism with the returning motion of the carriage E upon completion of printing for each line, so that that portion of the ribbon 35 which has been used for printing is taken up by the take-up spool 158. In this case, the amount of the ribbon 35 taken up by the spool 158 corresponds to the distance travelled by the carriage E for its returning motion. As described with respect to FIGS. 19 and 20, the head 26 is located with its head surface separated away from the platen 16 by means of the spring force of the flexible member 110 excepting a printing mode in which the head 26 moves in the printing direction. Thus, when the ribbon 35 is taken up by the spool 158, the ribbon 35 is released from the head 26 so that the ribbon 35 may be taken up to the spool 158 easily as well as smoothly.

Figure 35:
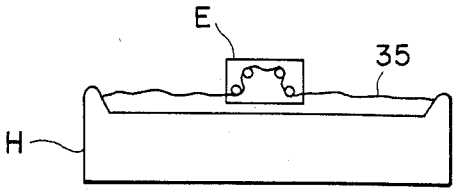
FIGS. 35 through 37 are schematic illustrations useful for explaining how slack in ink ribbon is removed.
Figure 36:
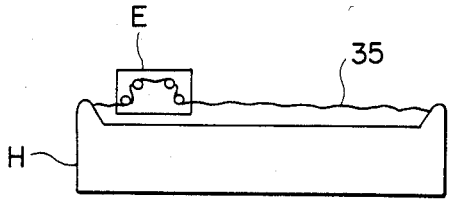
Figure 37:
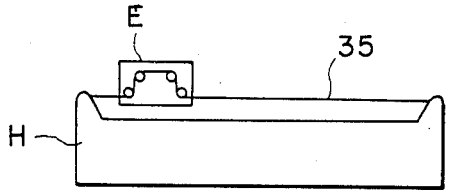

Referring now to FIGS. 35 through 37, a description is given of how the initial slack in the ribbon 35 may be removed. FIG. 35 illustrates the condition in which the ribbon 35 has been set in position as passing through the carriage E by the operator and thus the ribbon 35 is appreciably slackened. In this case, the carriage E is normally located toward the center so as to facilitate the setting operation of the ribbon 35 with respect to the head 26 and guide rollers 36–36*c*. FIG. 36 indicates the condition in which the carriage E is returned to the home position and FIG. 37 shows the condition in which the slack in the ribbon 35 has been removed by having the ribbon 35 taken up to the take-up spool 158.

Figure 38:
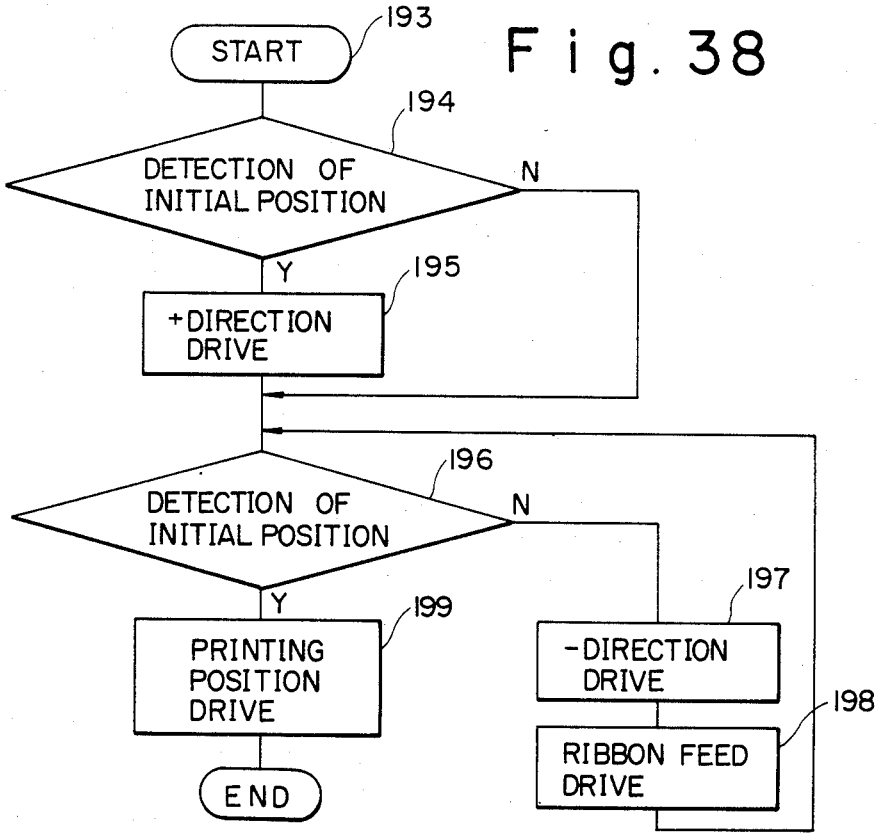
FIG. 38 is a flow chart showing the sequence of steps in removing an initial slack in the ink ribbon set in position.

FIG. 38 shows a flow chart showing a sequence of steps for removing the initial slack in the ribbon 35. As shown, at step 193, the print start switch is turned on. When a printing operation is about to start upon turning on of the print start switch, it is detected as to where the carriage E is located at step 194. If the carriage E is located at the home position, the motor 27 of the carriage driving mechanism F is driven over a predetermined amount once to the right temporarily at step 195. In this instance, since the if condition at step 196 is NO, it proceeds to steps 197 and 198 so that the carriage E is again returned to its home position and the motor 37 of the ribbon driving mechanism I is driven over a predetermined number of steps to take up the slack in the ribbon 35. Then, at step 199, the carriage E moves to a print start position from the home or initial position. On the other hand, if the carriage E is not located at the home position, since the if condition at step 196 is also NO, it proceeds to steps 197 and 198 thereby causing the carriage E to return to its home position and to take up the slack in the ribbon 35 by driving the motor 37. And, then, the carriage E is moved to the print start position.

Alternatively, the initial slack in the ribbon 35 may be removed by providing in the ribbon driving mechanism I a separate switch which may be manually operated other than the switch which is automatically turned on upon print start.

Figure 39:
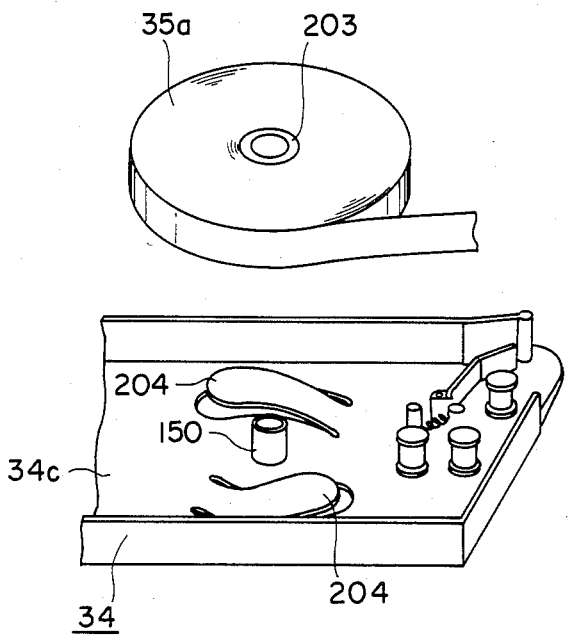
FIG. 39 is a fragmentary, perspective view showing a structure which provides a frictional resistance to a supply roll of ink ribbon.
Figure 40:
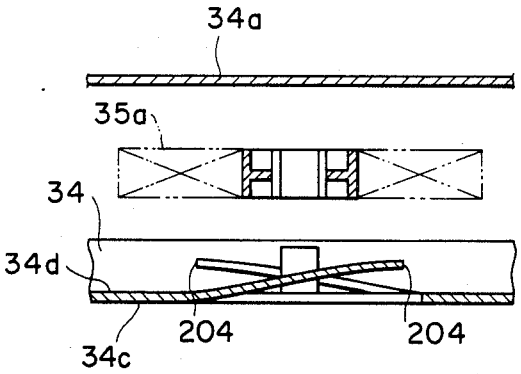
FIG. 40 is a cross-sectional view of the structure shown in FIG. 39.

The structure for mounting the roll 35*a* in the ribbon cassette H will now be described in detail with reference to FIGS. 39 and 40. The cassette 34 includes resistive members 204 which are located below and which may be brought into sliding contact with the roll 35*a* and/or its spool 203. In the illustrated embodiment, the resistive members 204 are formed by cutting the bottom wall 34*c* in a desired shape and bent upward above the bottom surface 34*d*. Thus, when the roll 35*a* is fitted onto the shaft 150, the resistive members 204 are immediately brought into contact with the roll 35*a*. With the top cover 34*a* mounted on the cassette main body 34, the roll 35*a* is prevented from being released from the shaft 150 and kept in position, thereby allowing a predetermined resistive force to be applied to the roll 35*a*.

Figure 41:
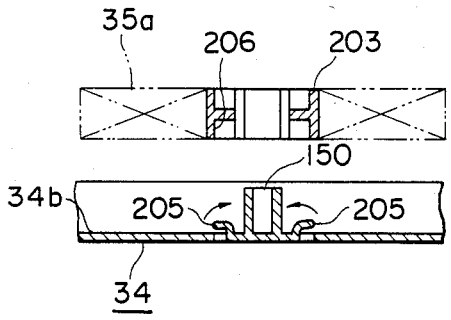
FIGS. 41 and 42 are cross-sectional views showing another embodiment of the frictional force providing structure.
Figure 42:
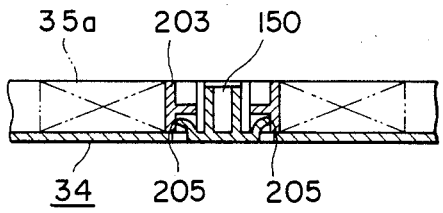

FIGS. 41 and 42 show another embodiment of the resistive members. The resistive members 205 in this embodiment are formed by partly cutting out the cassette bottom wall 34*c* such that they are flexible as in the previous embodiment and they may be brought into sliding contact with a hub inner peripheral surface 206 of the spool 203. In this case, when the supply spool 203 of the roll 35*a* is fitted onto the shaft 150, the resistive members 205 are forcibly bent inwardly with its tip end being pressed against the hub inner peripheral surface 206.

The resistive members 204 or 205 are structured as above and they apply a predetermined resistive force to the roll 35*a* against its rotation. Thus, the ribbon 35*a* is prevented from being freely rotated to supply the ribbon exceedingly. The above-described resistive members 204 and 205 are formed by cutting the bottom wall 34*c* of the cassette main body 34, but they may be formed as separate members and mounted in position to the cassette main body 34.

Figure 43:
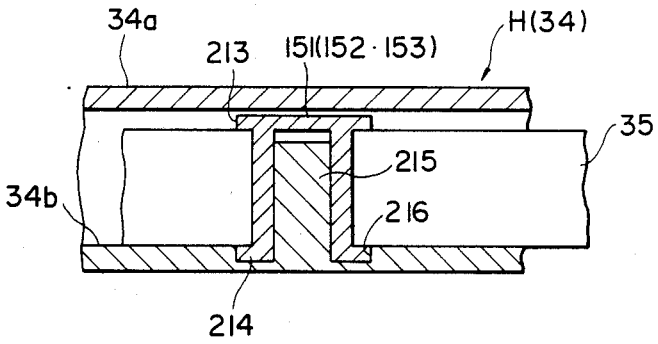
FIG. 43 is an enlarged cross-sectional view showing a guide roller in guiding the advancement of the ink ribbon.

Referring now to FIG. 43, the structure of the guide roller 151 (152, 153) in the ribbon cassette H will be described in detail. The guide roller 151 is provided with a pair of flanges 213 and 214 at top and bottom spaced apart over a distance corresponding to the width of the ribbon 35, and the guide roller 151 is rotatably fitted onto a pin 215 which projects upright from the bottom wall of the cassette main body 34. There is formed a groove 216 at the base of the pin 215 so as to allow the bottom flange 214 to be fitted therein with the inner surface of the bottom flange 214 being flush with the bottom surface 34*b* of the cassette main body 34. Therefore, the ink ribbon 35 may be fed along the bottom surface 34*b* as guided by the guide rollers 151, 152 and 153 without interference.

Figure 44:
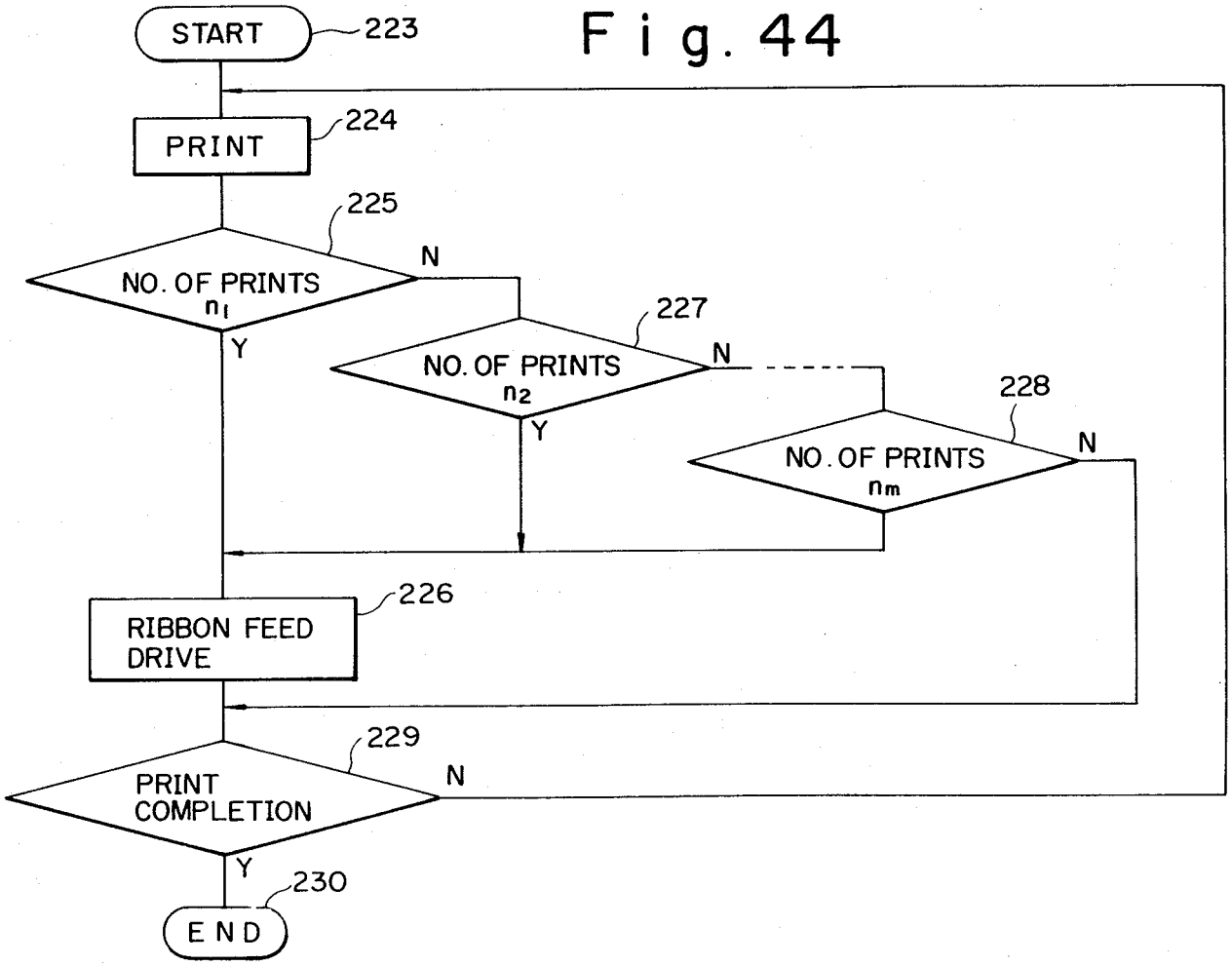
FIG. 44 is a flow chart showing the sequence of steps as an example in removing a slack in the ink ribbon during printing operation.
Figure 45:
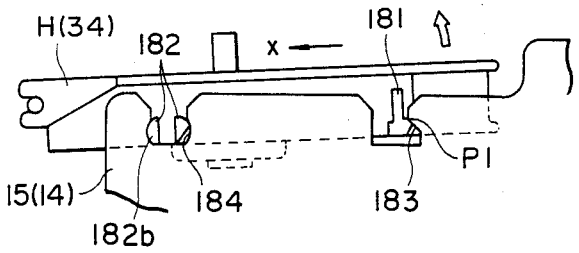
FIGS. 45 and 46 are schematic illustrations which are useful for explaining how the ribbon cassette is removed.

FIG. 44 is a flow chart showing the sequence of steps for preventing slack from being produced in the ribbon using the ribbon driving mechanism I. As shown, the print start switch is turned on at step 223. With this switch on, a printing operation initiates at step 224, and when the completion of a previously set number of prints has been detected, the flow goes to step 226. In the case where the number of printing characters per line is set to be "80" at step 225, if a slack removal operation is to be carried out three times during a printing operation for a line, it is so set that a detection signal is generated when the "20"th character has been printed. Thus, the other steps 227 and 228 are so set that detection signals are produced when the "40"th and "60"th characters have been detected.

In this manner, as soon as the preset characters have been printed, signals are sent from the steps 225, 227 and 228 to step 226. At step 226, upon receipt of a signal from each of the steps 225, 227 and 228, the ribbon driving motor 37 is driven to rotate over a predetermined amount. Thus, the driving shaft 39 is driven to rotate in the ribbon winding direction thereby taking up the ribbon to the supply spool to remove any slack in the ribbon momentarily. Such a momentary take up operation is carried out during printing operations.

Finally, the flow proceeds from step 228 to step 229, and if a print end condition is detected at step 229, it then proceeds to step 230. Thus, at step 230, the printing driving power is turned off thereby terminating a printing operation. In this case, if the print end condition is not detected at step 229, the flow goes back to step 224 to continue a printing operation.

In the above-described embodiment, at steps 225, 227 and 228, predetermined numbers of printed characters are detected to control the drive of the ribbon winding motor; however, detection of such control signals may also be carried out by dividing the travelling distance of the carriage E. Furthermore, the motor for taking up slack in the ribbon may be separately provided as mounted at the ribbon take up portion. Besides, removal of slack in the ribbon may be carried out by pulling the ribbon toward the supply spool instead of pulling the ribbon toward the take-up spool as in the above-described embodiment.

In detaching the ribbon cassette H from the printer, the rear side of the cassette H is first lifted upward as indicated by the white arrow thereby causing the first engaging projection 181 to be disengaged from the first engaging recess 183. In this case, the ribbon is supposed to be disengaged from the head 26 and rollers 36, 36*a*, 36*b* and 36*c*. Such a detachment of the cassette H is carried out, for example, for maintenance of the carriage E and replacement of the paper between plain paper and heat-sensitive paper.

When the rear end of the cassette H is lifted, the cassette H is slightly moved in the direction indicated by x due to flexibility provided by the forked second engaging projection 182 thereby allowing the first engaging projection 181 from being disengaged from the first engaging recess 183 smoothly. Thus, no strong shock will be produced as often encountered in the prior art structure. Moreover, since this disengaging pivotal motion causes the exteriorly existing ribbon to be located on top so that possibility of the ribbon interfering with other components may be greatly reduced.

Figure 46:
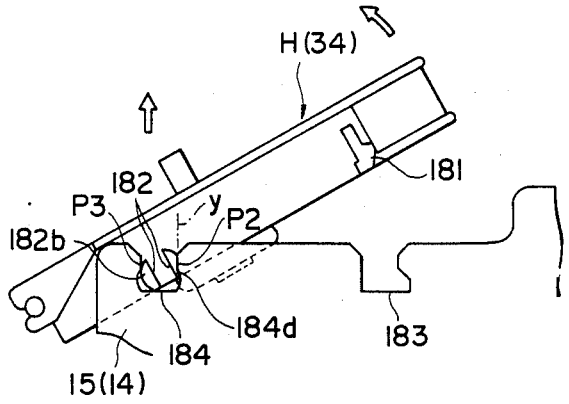

After having the first engaging projection 181 disengaged from the first engaging recess 183, the cassette H is then further moved pivotally upward as indicated in FIG. 46. This pivotal motion causes the cut surface 182*d* of the second engaging projection 182 to be aligned with a vertical line y and then the cassette H is simply pulled upward. Under the condition, the second engaging projection 182 may be easily disengaged from the second engaging recess 184.

FIGS. 47 through 50 illustrate another embodiment of the paper setting mechanism. In this embodiment, use is made of a spring member 73 mounted on the side plate 15 instead of the toggle spring in the previously described embodiment. Excepting the spring member 73, the present embodiment is structurally identical to the previously described embodiment and thus the same reference characters are used to denote the same elements.

Figure 47:
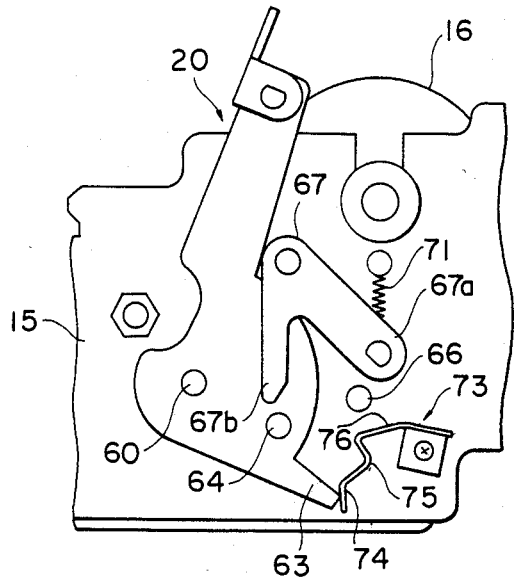
FIGS. 47 through 50 are schematic illustrations showing another embodiment of the paper setting mechanism.
Figure 48:
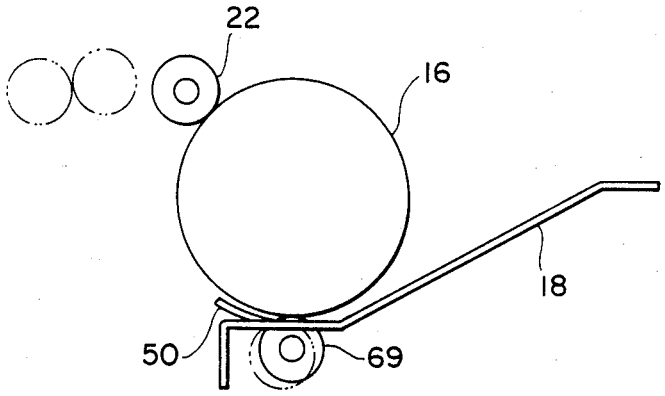

As shown, the spring member 73 has a wavy shape which thus provides three possible engaging portions 74, 75 and 76 with which the projection 63 of the lever 20 may be brought into engagement stepwise. When the projection 63 is in engagement with the first engaging portion 74 as indicated in FIG. 47, the spring member 73 applies a bias force to the lever 20 thereby biasing the lever 20 to pivot clockwise. Under the condition, the paper pressing rollers 22 are pressed against the platen 16 as indicated by the solid line in FIG. 48. At the same time, the paper transport rollers 69 are also pressed against the platen 16.

If it is desired to set the paper around the platen 16, the lever 20 must first be pivotted in the counterclockwise direction against the force of the spring member 73 to bring the projection 63 into engagement with the second engaging portion 75 thereby causing the paper pressing rollers 22 to be out of contact with the platen 16. Under the condition, the actuating shaft 64 is not yet operatively associated with the end 67*b* of the rocking cam 67 so that the paper transport rollers 69 are still pressed against the platen 16 as indicated by the solid line in FIG. 48. On the other hand, the paper set lever 20 may be held in position temporarily with the projection 63 in engagement with the second engaging portion 75 of the spring member 73. Under the circumstances, the paper may be lead below the platen 16 to be inserted between the platen 16 and the paper transport roller 69. Then, the platen 16 is driven to rotate over a predetermined amount thereby causing the paper automatically set around the platen 16. Thereafter, the lever 20 is pivotted clockwise against the force of the spring member 73 to bring the projection 63 into engagement again with the first engaging portion 74 to reestablish the condition illustrated in FIG. 47. Thus, the paper pressing roller 22 now presses the paper against the platen 16 thereby holding the paper properly around the platen 16 together with the paper transport roller 69. In this manner, the paper is set around the platen 16 to be ready for printing operation.

In the above-described operation, the paper is set around the platen 16 automatically with the paper pressing roller 22 separated away from the platen 16 and the paper transport roller 69 kept pressed against the platen 16. However, instead of this automatic paper setting operation, the paper may be set around the platen 16 as being inserted by hands as will be described below.

Figure 49:
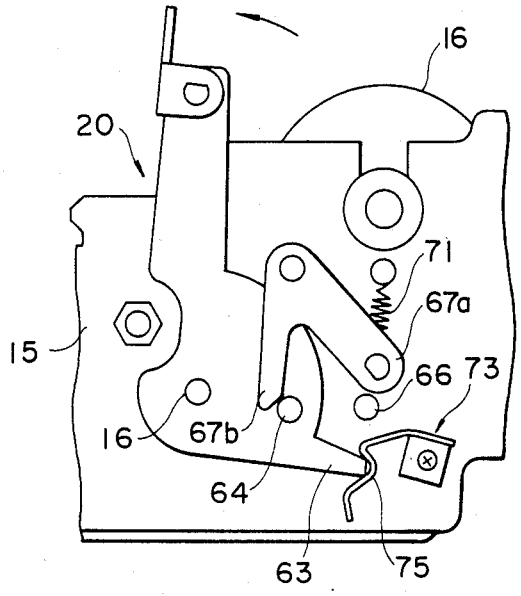
Figure 50:
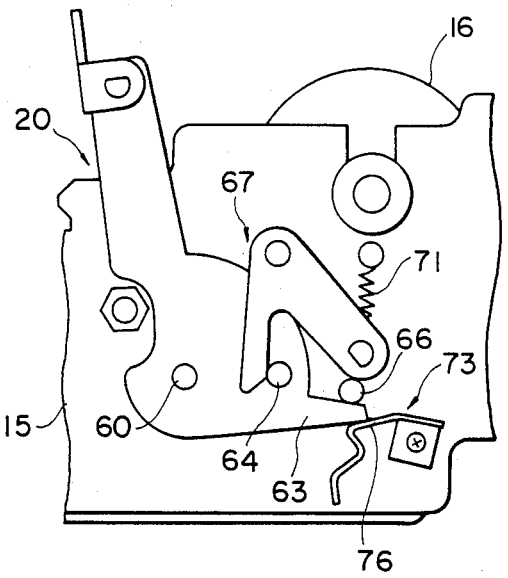

In this case, the paper set lever 20 is further pivotted counterclockwise against the force of the spring member 73 from the position shown in FIG. 49 to the position shown in FIG. 50 to bring the projection 63 into engagement with the stopper shaft 66. When the lever 20 is positioned as indicated in FIG. 50, the actuating shaft 64 comes slightly above the pivot 60, so that the lever 20 is now biased counterclockwise by the spring member 73. In this case, the lever 20 is held in this position with its pivotal motion being restrained by the stopper shaft 66 and the projection 63 being held between the stopper shaft 66 and the third engaging portion 76 of the spring member 73. As shown in FIG. 50, the rocking cam 67 is pivotted clockwise by the actuating shaft 64 so that the paper transport roller 69 is slightly separated away from the platen 16. Thus, the paper may be placed around the platen 16 by hands, and, then, the lever 20 is rotated clockwise against the force of the spring member 73 to the position shown in FIG. 47. As a result, the paper pressing roller 22 and the paper transport roller 69 are pressed against the paper around the platen 16, thereby completing a paper setting operation.

In the above-described embodiment, use is made of the tension spring 31 for biasing the rocking cam 67; however, in place of the tension spring 31, for example, a coil spring may be attached to the rocking cam to bias the rocking cam 67 so as to move the paper transport roller 69 away from the platen 16.

Figure 51:
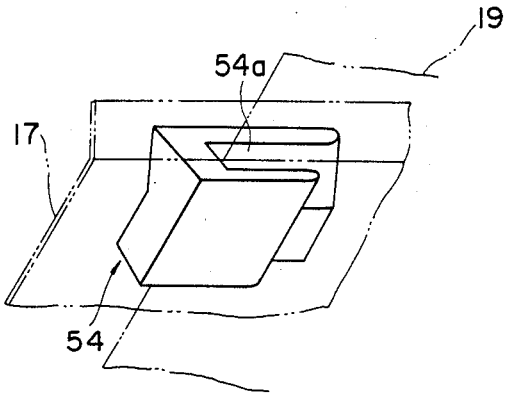
FIG. 51 is a schematic, perspective view showing another embodiment of the paper guide in the paper supplying mechanism.

FIG. 51 shows another embodiment of the guide piece 54 mounted on the upper guide plate 17. In this embodiment, the U-shaped guide piece 54 is bent upwardly to orient its entrance 54*a* directed above thereby facilitating the insertion operation of the paper 19 into the guide piece 54.

The above-described flexible member 72 in the head pressing mechanism of the present invention includes the first flexible portion 74*a* and second flexible portion 74*b*, which are different in the degree of flexibility, thereby causing the head 26 to be biased in opposite directions to move the head 26 closer to or away from the platen 16. However, in principle, as long as there are one flexible portion biasing the head 26 to move away from the platen 16 and the other flexible portion biasing the head 26 to move closer to the platen, the flexible member may take any other form and it should not be limited only to the above-described flexible member 72.

Figure 52:
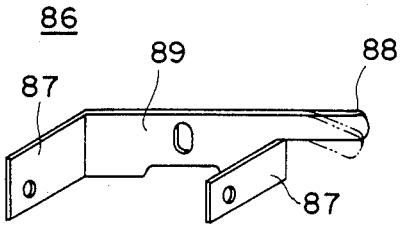
FIGS. 52 through 54 are schematic illustrations showing another embodiment of the printhead pressing mechanism.
Figure 53:
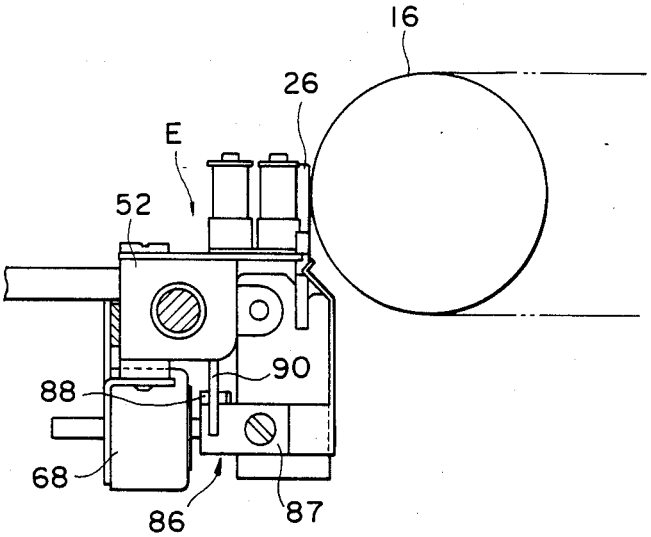
Figure 54:
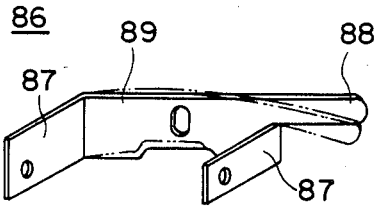

FIG. 52 shows the flexible member 86 constructed in accordance with another embodiment of the present invention. As shown, the flexible member 86 is generally U-shaped, and it includes a second flexible portion 89, a pair of mounting portions 87, 87 upstanding from both ends of the second flexible portion 89 and a first flexible portion 88 extending horizontally from one end of the second flexible portion 89. The flexible member 86 is so mounted with its mounting portions 87, 87 attached to both sides of the head 26, as shown in FIG. 53. The first flexible portion 88 is in engagement with a rod 90 depending downwardly from the carriage block 52. If the head 26 is to be separated away from the platen 16, only the first flexible portion 88 flexes as indicated by the two-dotted line in FIG. 52 so that the head 26 is biased to pivot counterclockwise in FIG. 53. On the other hand, if the head 26 is to be pressed against the platen 16, the second flexible portion 89 is also bent as indicated by the two-dotted line in FIG. 54 thereby causing the head 26 to pivot clockwise to be pressed against the platen 16.

In the above-described embodiment, the first flexible portion 88 extends horizontally with respect to the second flexible portion 89. Alternatively, however, the first flexible portions 88 may be provided to extend upwardly at an angle.

Figure 55:
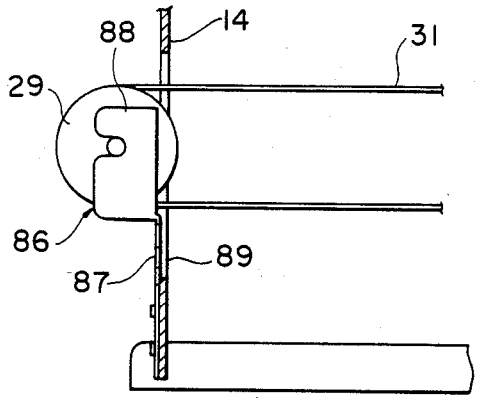
FIG. 55 is a schematic illustration showing another embodiment of the pulley holding structure.

FIG. 55 shows another embodiment of the pulley holding structure. In this case, the structure includes a holding member 86 which includes a mounting portion 87 and a holder portion 88 which extends straight from the mounting portion 87. However, the holding member 86 as a whole possesses a sufficient resiliency thereby allowing to keep the belt 31 in a predetermined tension state at all times. In this case, however, there must be provided a relatively larger relief opening 89 so as not to interfere with the required motion of the holding member 86. The holding member 86 may be mounted on the bottom plate 77 instead of the side plate 14, if desired.

Figure 56:
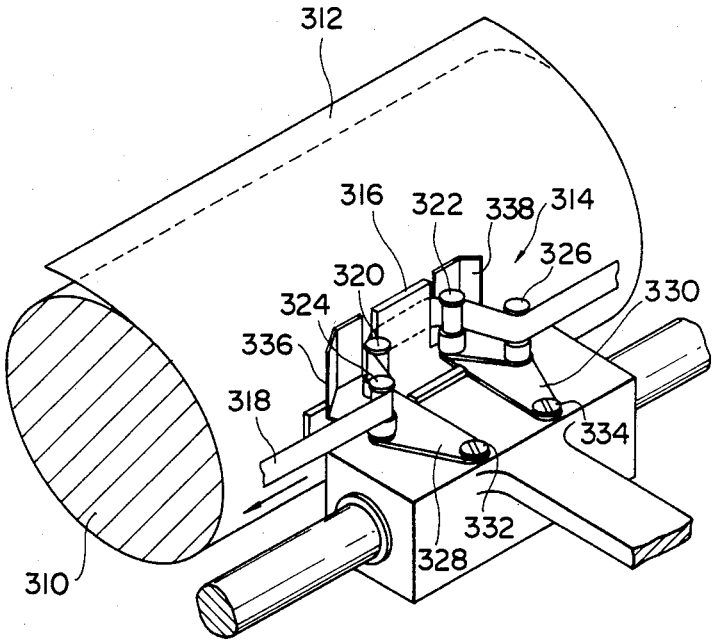
Fig. 56 PRIOR ART
FIG. 56 is a perspective view showing a prior art ink ribbon guiding mechanism in a transfer type thermal printer.

FIG. 56 shows a typical prior art transfer type thermal printer provided with a ribbon guide mechanism. As shown, a carriage 314 is provided to be movable along a platen, around which printing paper 312 is placed, in a reciprocating manner. The carriage 314 is provided with a thermal printhead 316 which is brought into pressure contact against the paper 312 with heat-sensitive ink ribbon 318 sandwiched between the head 316 and the paper 312. The ribbon 318 is pulled to advance in the direction indicated by the arrow as guided by the four ribbon guides 320, 322, 324 and 326. These ribbon guides are mounted on a pair of pivotal arms 328 and 330, whose base ends are pivotted to the carriage 314, for example, by screws 332 and 334. Thus, these pivotal arms 328 and 330 may pivot around the screws 332 and 334, respectively. These pivotal arms 328 and 330 are also provided with paper guides 336 and 338 at their front ends with a small distance separated away from the platen 110.

Figure 57:
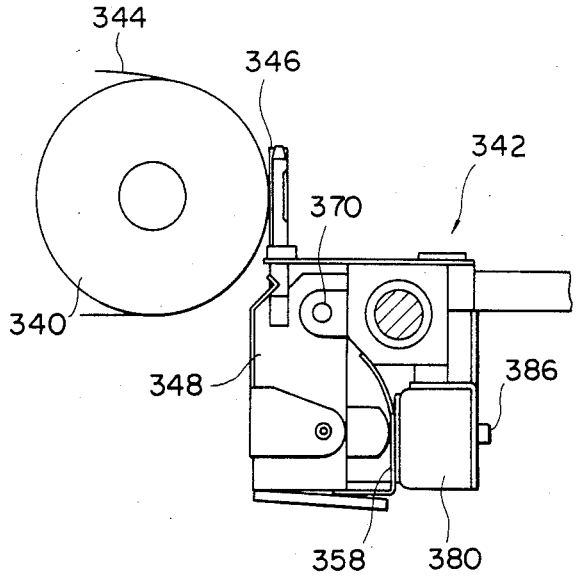

Now, in accordance with this aspect of the present invention, instead of providing separate ribbon and paper guides, there is provided a structure in which common guides are provided for guiding not only the ink ribbon but also the paper. That is, FIG. 57 shows a platen 340 and a carriage 342 which moves along the platen 340 in a reciprocating manner. Paper 344 is placed around the platen 340 and printing is effected on the paper 344 by a printing mechanism mounted on the carriage 342. The printing mechanism includes a thermal printhead 346 which is pressed against the paper 344 on the platen 340 with heat-sensitive ribbon 406 sandwiched between the head 346 and the paper 344. As well known in the art, a surface of the head 346 which is brought into contact with the ribbon 406 is provided with a plurality of heat-producing elements arranged in the form of a dot matrix, which are selectively activated to cause the ink of the ribbon 406 to melt thereby transferring the thus melt ink to the paper 344 to effect printing on the paper 344 as the carriage 342 moves along the platen 340.

The carriage 342 shown in FIG. 57 will be described further in detail with reference to an exploded view of FIG. 59. As shown, the thermal printhead 346 is generally cross-shaped and its top vertical portion 346*a* is provided with a plurality of heat-producing elements arranged in the form of a dot matrix at the side facing the platen with a plurality of connector pins 346*b* connected from the respective heat-producing elements extending downwardly from the bottom end of its bottom vertical portion.

The thermal printhead 346 is inserted into a head holder 348 with its horizontally extending portions 346*c* and 346*d* fitted into grooves 348*a* and 348*b* of the holder 348. The head holder 348 is generally in the form of a box and has a flexible plate 150 as mounted at the platen side. The flexible plate 150 includes a pair of spring portions 350*a* and 350*b* located above the grooves 348*a* and 348*b*, respectively, and they serve to prevent the head 346 from slipping away. With the head 346 set in the holder 350, the connector pins 346*b* are plugged into a connector 352 mounted on a base 354, which, in turn, is fixedly attached to one end of a flexible printed plate 356. The flexible printed plate 356 is so provided to follow the motion of the carriage 342 and fixedly provided with a connector for connection with a control section at the other end. The base 354 on the flexible printed plate 356 is attached to the head holder 348 by means of mounting screws 360, 362 with a base portion 358*a* of a leaf spring 358 sandwiched therebetween. When so mounted, the connector 352 projects into the interior of the holder 348 through its bottom window 348*c*.

The head holder 348 is mounted on the carriage block 364 as inserted between a pair of holding arms 366 and 368 which project sideways from the block 364. The head holder 348 is pivotally supported to the holding arms 366 and 368 by means of a mounting shaft 370. The carriage block 364 includes a tail piece 364*a* which extends horizontally to the front and whose tip end (not shown) is movably supported by the printer main body. The carriage block 364 moves along the platen 340 as guided by a guide shaft 372 as indicated by the one-dotted line. There is also provided a solenoid mounting plate 374 as mounted on the carriage block 364 by means of screws 382 and 384 below the tail piece 364*a*. A solenoid 380 is provided as connected to a solenoid connector and actuated in accordance with a control signal supplied through the flexible printed plate 356. The solenoid 380 includes an actuating lever 386 which is provided with a disk 386*a* having a relatively large diameter at the platen side. Although not shown specifically, the forward end of the disk 386*a* is provided with a smaller diameter portion which may be fitted into a slot 358*b* formed in the leaf spring 358. With the smaller diameter portion extending through the slot 358*a*, a fixture member 388 is fixed to the smaller diameter portion by means of a screw 390. Thus, a flexible portion 358*c* of the leaf spring 358 becomes sandwiched between the fixture member 388 and the disk 386*a*. The tip end of the flexible portion 358*c* is pressed against the platen side surface of the carriage block 364.

Figure 58:
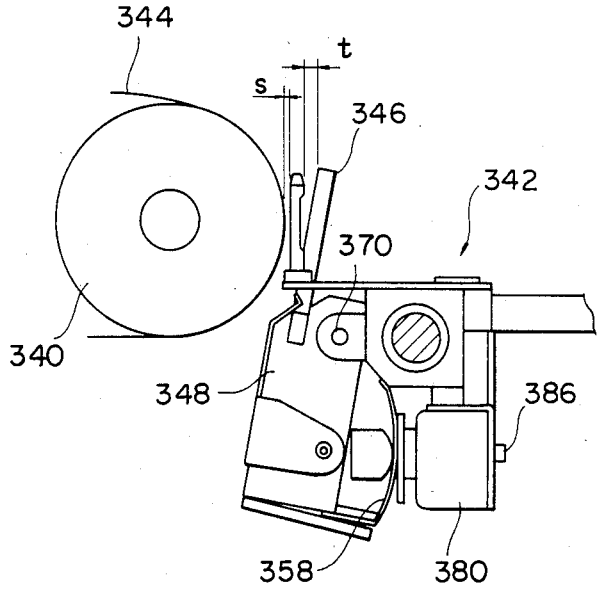

Under normal condition, as shown in FIG. 58, the head holder 348 is biased to pivot clockwise around the mounting shaft 370. During printing operation, the solenoid 380 is energized to retract the actuating lever 386 thereby pulling the leaf spring 358 toward the solenoid 380, and, thus, as shown in FIG. 57, the head holder 348 is biased to pivot counterclockwise around the mounting shaft 370 so that the head 346 is pressed against the platen 340.

Figure 59:
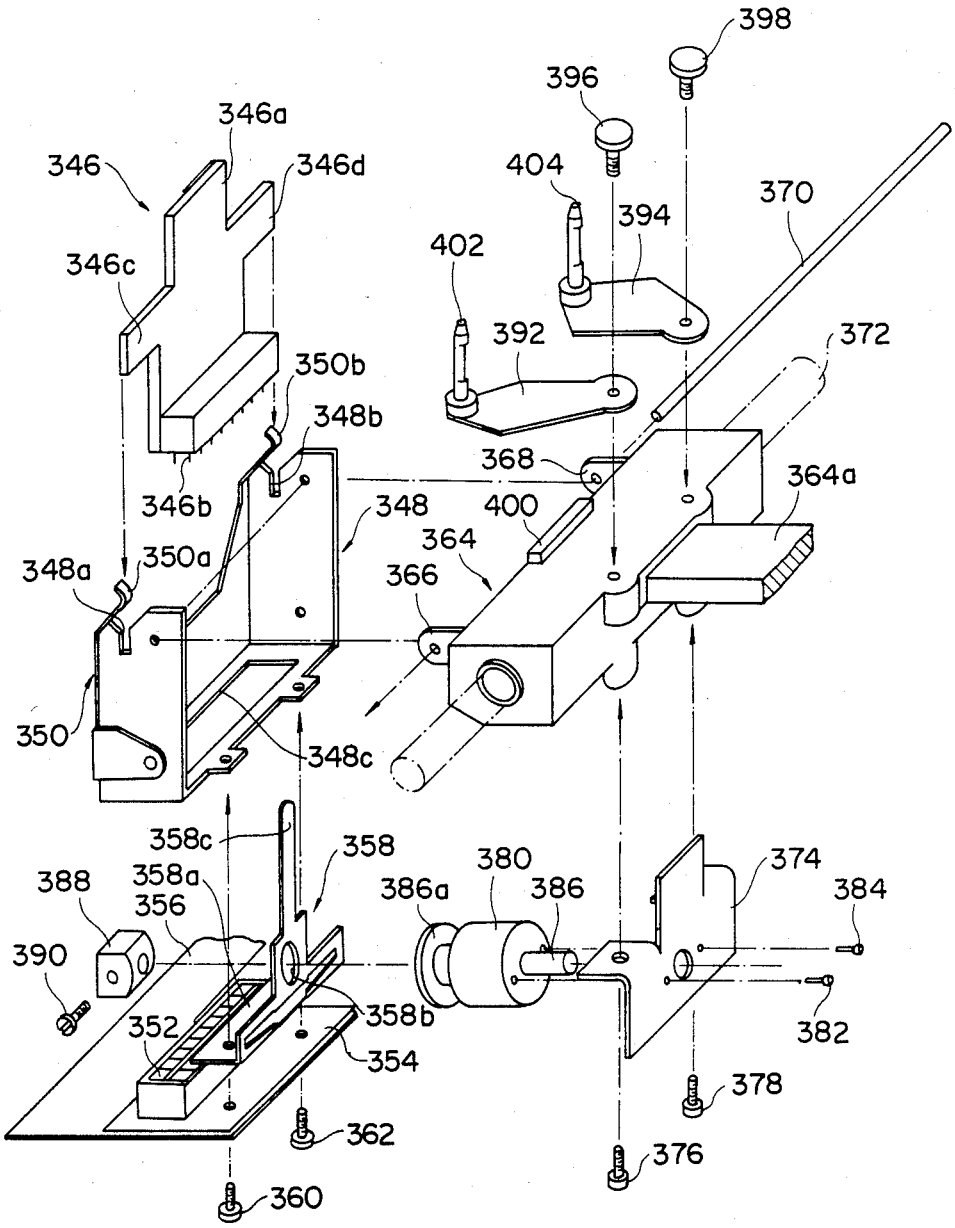
FIG. 59 is an exploded, perspective view showing in detail the structure of the carriage shown in FIGS. 57 and 58.
Figure 60:
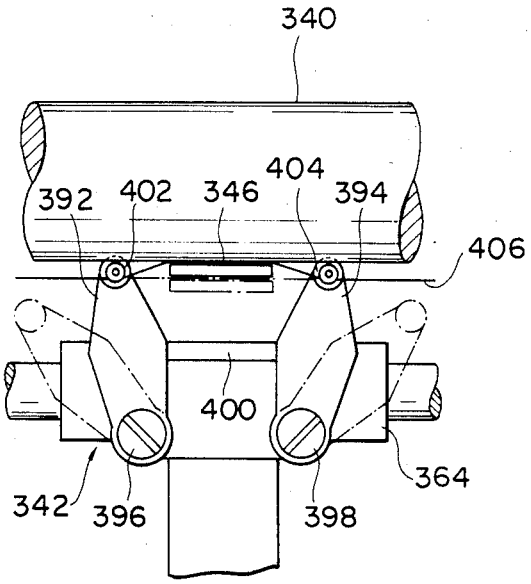
FIG. 60 is a plan view of the structure shown in FIG. 57.

As shown in FIG. 59, a pair of pivotal arms 392 and 394 is provided with their base ends pivotally mounted on the carriage block 364 by means of mounting screws 396 and 398, respectively. As shown in FIG. 60, these pivotal arms 392 and 394 are so oriented with their inner sides abutted against both ends of a stopper 400 provided on the carriage block 364 with their tip ends directed toward the platen, and, thus, the arms 392 and 394 are arranged approximately perpendicular to the platen 340. As indicated by the one-dotted line in FIG. 60, these pivotal arms 392 and 394 may be moved away from each other around their pivots 396 and 398, respectively.

Figure 61:
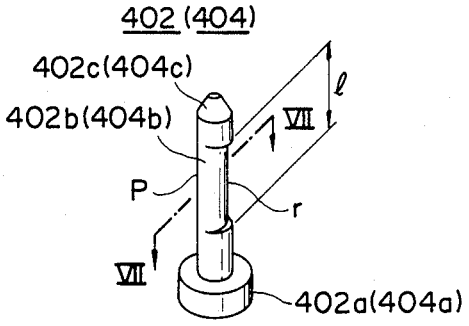
FIG. 61 is a perspective view showing the guide member provided in the carriage of FIG. 57.
Figure 62:
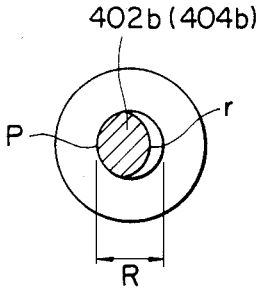
FIG. 62 is a cross-sectional view taken along VII—VII line indicated in FIG. 61.

Guide members 402 and 404 are provided at the forward ends of the pivotal arms 392 and 394 as extending upright, respectively. These guide members 402 and 404 are rod-shaped, and, as shown in FIG. 61, each of these guide members 402 and 404 includes a base portion 402*a* (404*a*) having a larger diameter, a guide portion 402*b* (404*b*) having a smaller diameter and a convergent portion 402*c* (404*c*) on top of the guide portion. As shown in FIG. 62, the guide portion 402*b* (404*b*) has a constant diameter R and that portion of the peripheral surface which faces the platen 340 defines a paper guiding surface p. Then, when the pivotal arms 392 and 394 are brought into abutment against the stopper 400, the paper guiding surface p is located opposite to the platen 340 with a small gap delta therebetween, as shown in FIG. 58. As shown in FIG. 61, that side of the guide portion 402*b* (404*b*) which is opposite to the paper guiding surface p is cut away over a distance 1, as shown in FIG. 61, thereby forming a curved surface which is shifted from its original outer peripheral surface and which defines a ribbon guiding surface r. Thus, the ribbon guiding surface r is formed as recessed at the side opposite to the side where the paper guiding surface p is defined.

With the thermal printer structured as described above, in order to mount the thermal printhead 346, the pivotal arms 392 and 394 are pivotted to move away from each other as indicated by the one-dotted line in FIG. 60, thereby establishing the condition indicated in FIG. 58. At this time, there is formed a gap t between the guide members 402, 404 and the tip end of the head 346 so that the ribbon 406 may be inserted through this gap to be in contact with the ribbon guiding surface r as indicated by the one-dotted line in FIG. 60. Then, when printing is to be carried out, the solenoid 380 is energized to press the head 346 against the platen 340 with the ribbon 406 sandwiched therebetween, as indicated by the solid line in FIG. 60. Thus, with the length 1 of the ribbon guiding surface r determined to be equal to or slightly larger than the width of the ribbon 406, meandering in advancement of the ribbon 406 may be prevented from occurring.

It is to be noted that the guide members 402 and 404 may be mounted on other elements, such as the carriage block 364, in place of the pivotal arms 392 and 394 as in the above-described embodiment. It is also to be noted that the guide members 402 and 404 may have any other desired shape as long as they are suitable in guiding the advancement of paper and ribbon.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A thermal printer for thermally printing information on a recording medium, said printer comprising:

a platen for guiding the advancement of said recording medium;

a thermal printhead;

a carriage mounting thereon said thermal printhead, said carriage being movable along a predetermined path extending in parallel with a longitudinal axis of said platen in a reciprocating manner;

means for pressing said printhead against said platen while said carriage is moving in a first direction along said predetermined path, in which printing is effected, and keeping said printhead separated away from said platen while moving in a second direction, in which no printing is effected and which is opposite to said first direction along said predetermined path;

a detachably mountable cassette containing therein heat-sensitive ink ribbon which partly extends outside of said cassette from a supply port to a take-up port defined in said cassette, said cassette being substantially elongated and its longitudinal direction being in parallel with said predetermined path when mounted;

a ribbon driving mechanism mounted in said printer; and advancing means for advancing and controlling feeding of said ribbon from said supply port to said take-up port in association with the motion of said carriage in said second direction, said advancing means being mounted in said cassette and being operatively coupled to the ribbon driving mechanism of said printer when the cassette is mounted in position.

2. The printer of claim 1 further comprising a pair of side plates held vertically on both ends of said predetermined path, wherein said cassette is elongated enough to bridge between said pair of side plates when mounted.

3. The printer of claim 2 wherein said side plates are provided with first engaging means at their top ends and said cassette is provided with second engaging means on both sides, whereby said first and second engaging means are brought into detachable engagement when said cassette is mounted in position.

4. The printer of claim 3 wherein said first engaging means includes notches formed at the top ends of said side plates and said second engaging means includes projections provided on both sides of said cassette, whereby said projections may be fitted into the corresponding ones of said notches when said cassette is mounted in position.

5. The printer of claim 2 wherein said supply and take-up ports are provided on both ends of said cassette along its longitudinal direction so that that portion of said ribbon outside of said cassette extends substantially along said predetermined path.

6. The printer of claim 1 wherein said recording medium is heat-sensitive paper, whereby said cassette is detached to effect printing.

7. The printer of claim 1 wherein said recording medium is plain paper, whereby said cassette is mounted in position.

8. The printer of claim 1 further comprising means for storing said recording medium in the form of a roll and means for supplying said recording medium unwound from said roll to be placed around said platen.

9. The printer of claim 8 wherein said storing means includes holding means for holding said roll of recording medium, said holding means being capable of holding at least two differently widthed rolls of recording medium interchangeably.

10. The printer of claim 9 wherein said holding means includes first rollers having a first diameter which are rotatably held as spaced apart from each other over a first distance and second rollers having a second diameter different from said first diameter which are rotatably held as spaced apart from each other over a second distance, whereby a first roll of recording medium having a first width may be set in operative position when placed on said first rollers and a second roll of recording medium having a second width may be set in operative position when placed on said second rollers.

11. The printer of claim 8 further comprising means for guiding said recording medium in the form of cut sheet to be placed around said platen.

12. The printer of claim 1 further comprising means for keeping said recording medium in contact with said platen and means for driving to rotate said platen, whereby said recording medium is advanced to the next printing line when said platen is driven to rotate over a predetermined angle by said driving means.

13. The printer of claim 1 wherein said printhead is provided with a plurality of heat-producing elements arranged in a line at a predetermined pitch.

14. The printer of claim 13 wherein said carriage is provided with guiding means for guiding said ribbon extending outside of said cassette along said printhead.

15. The printer of claim 14 wherein said guiding means includes a pair of arms pivotally supported on said carriage as spaced apart from each other and at least one guide roller mounted on each of said arms, whereby said ribbon extends around said rollers and along said printhead when said cassette is mounted in position.

16. The printer of claim 15 wherein said guiding means further includes a stopper member provided on said carriage and between said pair of arms, whereby said arms are held in abutment against both ends of said stopper member thereby orienting said arms to extend approximately perpendicular to said platen.

17. The printer of claim 15 wherein each of said arms is provided with a guiding portion for guiding the movement of said recording medium.

18. The printer of claim 17 wherein said guiding portion is formed at a free end of a corresponding one of said arms.

19. The printer of claim 17 wherein each of said arms is provided with a single guide roller which is formed with said guiding portion.

20. The printer of claim 19 wherein said guide roller is partly cut away over a predetermined distance along its longitudinal axis thereby defining a recess for guiding said ribbon.

21. The printer of claim 1 wherein said advancing means includes a driving roller rotatably provided in said cassette and a pinch roller which is also rotatably provided in said cassette and is normally pressed against said driving roller, with said ribbon sandwiched therebetween, said driving roller becoming operatively coupled to said ribbon driving mechanism when said cassette is mounted in position.

22. The printer of claim 21 wherein said advancing means further includes a spring for causing said pinch roller to be normally pressed against said driving roller.

23. The printer of claim 22 wherein said cassette is provided with a take-up spool which is rotatably supported and operatively connected to said driving roller to rotate in association with said driving roller.

24. The printer of claim 23 wherein an endless belt is provided to extend between said driving roller and said take-up spool.

* * * * *